US010596714B2

(12) United States Patent
Peter et al.

(10) Patent No.: US 10,596,714 B2
(45) Date of Patent: Mar. 24, 2020

(54) ELECTRIC SHAVER

(71) Applicant: Braun GmbH, Kronberg (DE)

(72) Inventors: Andreas Peter, Kronberg (DE); Cirilo Javier Perez Lopez, Frankfurt am Main (DE); Andreas Erndt, Kelkheim (DE); Detlef Gleich, Friedrichsdorf (DE); Sebastian Hottenrott, Idstein (DE); Tobias Schwarz, Schmitten (DE)

(73) Assignee: Braun GMBH, Kronberg (DE)

( * ) Notice: Subject to any disclaimer, the term of this patent is extended or adjusted under 35 U.S.C. 154(b) by 72 days.

(21) Appl. No.: 15/714,991

(22) Filed: Sep. 25, 2017

(65) Prior Publication Data

US 2018/0085938 A1 Mar. 29, 2018

(51) Int. Cl.
*B26B 19/04* (2006.01)

(52) U.S. Cl.
CPC ..... *B26B 19/048* (2013.01); *B26B 19/046* (2013.01)

(58) Field of Classification Search
CPC ..... B26B 19/046; B26B 19/048
See application file for complete search history.

(56) References Cited

U.S. PATENT DOCUMENTS 4,700,476 A 10/1987 Locke et al.
6,226,871 B1 * 5/2001 Eichhorn ..... B26B 19/048 30/346.51
7,020,966 B2 * 4/2006 Shiba ..... B26B 19/046 30/346.51
9,399,302 B2 * 7/2016 Shimizu ..... B26B 19/048
2011/0094107 A1 * 4/2011 Ring ..... B26B 19/048 30/43.1
2018/0085938 A1 * 3/2018 Peter ..... B26B 19/048
2018/0085939 A1 * 3/2018 Krauss ..... B26B 19/042
2018/0085940 A1 * 3/2018 Krauss ..... B26B 19/042
2018/0085941 A1 * 3/2018 Krauss ..... B26B 19/048
2018/0085951 A1 * 3/2018 Krauss ..... B26B 19/3893

FOREIGN PATENT DOCUMENTS

JP 2016077464 5/2016

OTHER PUBLICATIONS

European search report dated Mar. 28, 2017.

* cited by examiner

*Primary Examiner* — Hwei-Siu C Payer
(74) *Attorney, Agent, or Firm* — Kevin C. Johnson

(57) ABSTRACT

Electric shaver provided with a handle and a shaver head including at least one cutter element, wherein the shaver head is connected to the handle by a support structure providing for a swivel and/or tilting axis about which the shaver head may swivel or tilt relative to the handle, wherein the cutter element is drivable by a drive unit in an oscillating manner along a cutter oscillation axis, the drive unit including an elongated drive transmitter coupled to the cutter element.

17 Claims, 14 Drawing Sheets

ELECTRIC SHAVER

FIELD OF THE INVENTION

The present invention relates to an electric shaver having a shaver head that may self-adapt its angular position to the skin contour. More particularly, the present invention relates to an electric shaver comprising a handle and a shaver head including at least one drivable cutter element, wherein said shaver head is connected to said handle by means of a support structure providing for a swivel and/or tilting axis about which said shaver head including the cutter element may swivel or tilt relative to said handle, wherein said cutter element is driveable by a drive unit in an oscillating manner along a cutter oscillation axis, wherein said drive unit includes an elongated drive transmitter coupled to said cutter element.

BACKGROUND OF THE INVENTION

Electric shavers usually have one or more cutter elements driven by an electric drive unit in an oscillating manner where the cutter elements reciprocate under a shear foil, wherein such cutter elements or undercutters may have an elongated shape and may reciprocate along their longitudinal axis. Other types of electric shavers use rotatory cutter elements which may be driven in an oscillating or a continuous manner. Said electric drive unit may include an electric motor or a magnetic-type linear motor, wherein the drive unit may include a drive train having elements such as an elongated drive transmitter for transmitting the driving motion of the motor to the cutter element, wherein said motor may be received within the handle portion of the shaver or in the alternative, in the shaver head thereof.

Irrespective of the architecture of the drive unit and the drive train, the cutter elements, in addition to the aforementioned cutting motion, may be movable in other directions so as to self-adapt to the contour of the skin to be shaved. For example, the cutter elements may be part of a shaver head that is slewable about one or more axes relative to the handle of the shaver, wherein the support structure connecting the shaver head to the handle may allow the shaver head to swivel about a swivel axis extending substantially parallel to the elongated cutter elements and/or the reciprocating axis thereof. In addition or in the alternative, the supporting structure may allow the shaver head to tilt about a tilting axis extending transverse to the longitudinal axis of the handle and transverse to the elongated cutter elements and/or the reciprocating axis thereof. In addition to or in the alternative to such shaver head movements, the cutter elements may dive into the shaver head so as to adjust the position relative to the skin contour to be shaved.

Due to the slewing movements of the shaver head and its cutter elements relative to the handle, transmission of the driving movements from a motor to the cutter elements is sometimes difficult, in particular when the drive unit includes a motor accommodated in the handle and connected to the cutter elements in the shaver head via a drive train that needs to compensate for the tilting and/or swiveling movements of the cutter elements relative to the handle and thus, relative to the motor in the handle. Such compensation may be achieved by flexible elements in the drive train allowing for misalignment of the cutter element's coupling to the drive train and a drive train portion fixedly aligned with the handle. Another compensation approach is to provide for play in a coupling part, for example a drive pin received in a slot-like recess such as an oblong hole. However, such compensation of the tilting or swiveling movements through flexible elements or play reduces efficiency of power transmission and limits the achievable oscillation frequencies.

For example, US 2009/0025229 A1 discloses an electric shaver having a pair of cutter elements provided under a shear foil and driven in an oscillating manner along a cutter oscillation axis, wherein the oscillating driving movements of transmitter pins extending into the shaver head are applied onto the cutter elements via an oscillatory bridge supported for oscillatory reciprocation in said shaver head, wherein said oscillatory bridge includes yielding coupling arms so as to compensate for the adjusting movements of the cutter elements. Due to the rather complex shape of the oscillatory bridge, however, the transmission architecture is rather complicated, bulky and difficult to clean. Moreover, the yielding structure of the oscillatory bridge is power-consuming and detrimental to achieving high frequencies of oscillation of the cutter elements.

A similar transmission architecture including an oscillation bridge of a pivoting type is known from U.S. Pat. No. 7,841,090 B2.

Due to the limited space available in the shaver head and the rather bulky structure of such oscillation bridges, it is also difficult to avoid a collision of the drive train with the support structure allowing slewing of the shaver head. Of course, such drive train could be significantly reduced in size and the compensation of misalignments could easily be avoided by means of accommodating the entire drive unit including the motor in the shaver head. However, such approach significantly increases the weight of the shaver head and thus, its responsiveness to contour changes, and in addition, handling of the shaver is impaired due to unbalanced mass. So as to avoid such collision between the drive train extending from the handle into the shaver head, it has been tried to reduce the support structure for the shaver head in size. Such support structure connecting the shaver head to the handle may have different configurations so as to allow for the aforementioned swiveling and/or tilting movements and to avoid collisions with the drive train extending from the drive unit to the cutter element. For example, prior art reference US 2010/0175264 A1 shows a four-joint linkage of the shaver head to the handle, wherein link arms are arranged in a sort of pendulum or hanging arrangement. An interposer part attached to the handle includes two poles projecting upwards into the shaver head, wherein the link arms are pivotably attached to the top end portions of such poles to extend or hang downwards back towards to the handle. The lower end portions of such hanging link arms are pivotably connected to a shaver head frame.

A similar support structure movably connecting the shaver head of an electric shaver to the handle thereof is shown by reference JP 2016-77464 A also showing a four-joint linkage including a pair of hanging link arms.

Another shaver allowing for swiveling and tilting of the shaver head of an electric shaver about swiveling and tilting axes is shown by EP 2 435 218 B1 suggesting a cardanic support structure including a shaver head frame pivotably mounted to a cradle-like handle part and, on the other hand, pivotably supporting a cutter frame on which the cutter element is supported.

Furthermore, AT 409604 B shows an electric shaver having cutter elements which may, in addition to the oscillating cutting movements, pivot about an axis perpendicular to the shaver's longitudinal axis and the axis of oscillation of the cutter element so as to allow for adjustment of the cutter element position to the skin to be shaved, and rotatorily oscillate about an axis parallel to the longitudinal axis of the shaver housing. The transmission train connecting the drive motor to the cutter elements includes a coupling structure rotatorily oscillating about a pivot axis parallel to the shaver housing's longitudinal axis.

US 2009/0025229 A1 discloses a drive unit for the cutter elements of an electric shaver, wherein the drive unit includes transmitter pins extending from the shaver housing towards the shaver head, wherein the oscillating driving movements of said transmitter pins are applied onto the cutter elements via an oscillatory bridge supported for oscillatory reciprocation in the shaver head, wherein said oscillatory bridge includes yielding coupling arms so as to allow for adjusting movements of the cutter elements. A similar transmission architecture is known from U.S. Pat. No. 7,841,090 B2.

Further electric shavers allowing for adapting movements of the cutter elements are known from U.S. Pat. No. 3,748,371 B, FR 1391957 A, GB 811,207 B and U.S. Pat. No. 5,704,126 B.

SUMMARY OF THE INVENTION

It is an objective underlying the present invention to provide for an improved electric shaver avoiding at least one of the disadvantages of the prior art and/or further developing the existing solutions. A more particular objective underlying the invention is to provide for an improved transmission architecture for transmitting the drive unit's action to the at least one cutter element of a shaver head slewable relative to the handle, wherein power dissipation of the transmission structure is low, high frequencies are achievable and the cutter element shows a direct response to the driving action of the drive unit.

Another objective underlying the present invention is to provide for an improved drive train structure and support structure connecting the shaver head to the handle to allow the shaver head self-adjusting its position relative to the handle and avoiding collisions between the drive train driving the cutter element and the support structure without restrictions to the drive train.

A further objective underlying the invention is to allow for a better self-adaption of the angular position of the shaver head to the skin contour to be shaved, but still achieving efficient driving of the cutter elements, including a better responsiveness of self-adjusting swivel and tilt movements of the shaver head to changing skin contours when moving the shaver head along the skin contour to be shaved with less pressure applied to the functional shaver head surface contacting the skin contour and/or a quicker readjustment of the shaver head into its neutral position with less restoring forces, wherein at the same time high driving frequencies are achievable.

To achieve at least one of the aforementioned objectives, the electric shaver may provide for a direct coupling of the elongated drive transmitter to the at least one cutter element avoiding any oscillatory yielding bridge structure between the elongated drive transmitter and the cutter element. More particularly, the elongated drive transmitter may be coupled to the cutter element by means of a pivot joint providing for a pair of pivot axes extending perpendicular to each other and transverse to a longitudinal axis of said elongated drive transmitter. In order to allow for self-adjusting movements of the cutter element transverse to the cutting oscillation, the pivot joint may be displaceably mounted to the elongated drive transmitter and/or to the cutter element to allow for displacement of the pivot joint relative to said cutter element in a first direction transverse to the cutter oscillation axis and to the longitudinal axis of the elongated drive transmitter and, furthermore, relative to the elongated drive transmitter and/or to the cutter element in a second direction substantially parallel to the elongated drive transmitter's longitudinal axis.

Nevertheless, the pivot joint is fixedly mounted to the elongated drive transmitter and the cutter element in the direction of the cutter oscillation axis. In other words, the pivot joint connects the elongated drive transmitter to the cutter element basically without any play in the direction of the cutter oscillation axis, whereas, on the other hand, the pivot joint allows for displacement of the elongated drive transmitter relative to the cutter element in the aforementioned first and second directions, wherein such possible displacement is more than just the usual play due to manufacturing tolerances. For example, possible displacements in said first and second directions may amount to 25% or more of the amplitude of the cutter element's reciprocation or oscillation. The movability of the pivot joint to allow said displacement in the first and second directions is given to an extent allowing for compensation of the movements of the cutter element relative to the drive transmitter due to rotation of the shaver head including the cutter element about the aforementioned pivot axis and/or swiveling axis.

A direct, pivotable connection of the elongated drive transmitter to the cutter element may help in achieving low power dissipation of the transmission train and a direct response of the cutter element to the driving movements of the elongated drive transmitter, thus allowing for high oscillation frequencies. The elongated drive transmitter may form a rigid structure extending to or into the cutter element and directly push and/or pull the cutter element to effect the cutting movement. The pivot joint coupling the elongated drive transmitter to the cutter element allows for tilting and/or swiveling of the cutter element relative to the drive transmitter, wherein the slidable mounting of the pivot joint to the drive transmitter and/or to the cutter element allows for compensation of movements of the cutter element relative to the drive transmitter due to misalignment of the axis about which the cutter element tilts or rotates relative to the drive transmitter despite a possible direct transmission of driving action along the axis of oscillation without play between the elongated drive transmitter and the cutter element and without flexibility of the drive train in the direction of oscillation of the cutter element.

These and other advantages become more apparent from the following description giving reference to the drawings and possible examples.

DETAILED DESCRIPTION OF THE INVENTION

Figure 1:
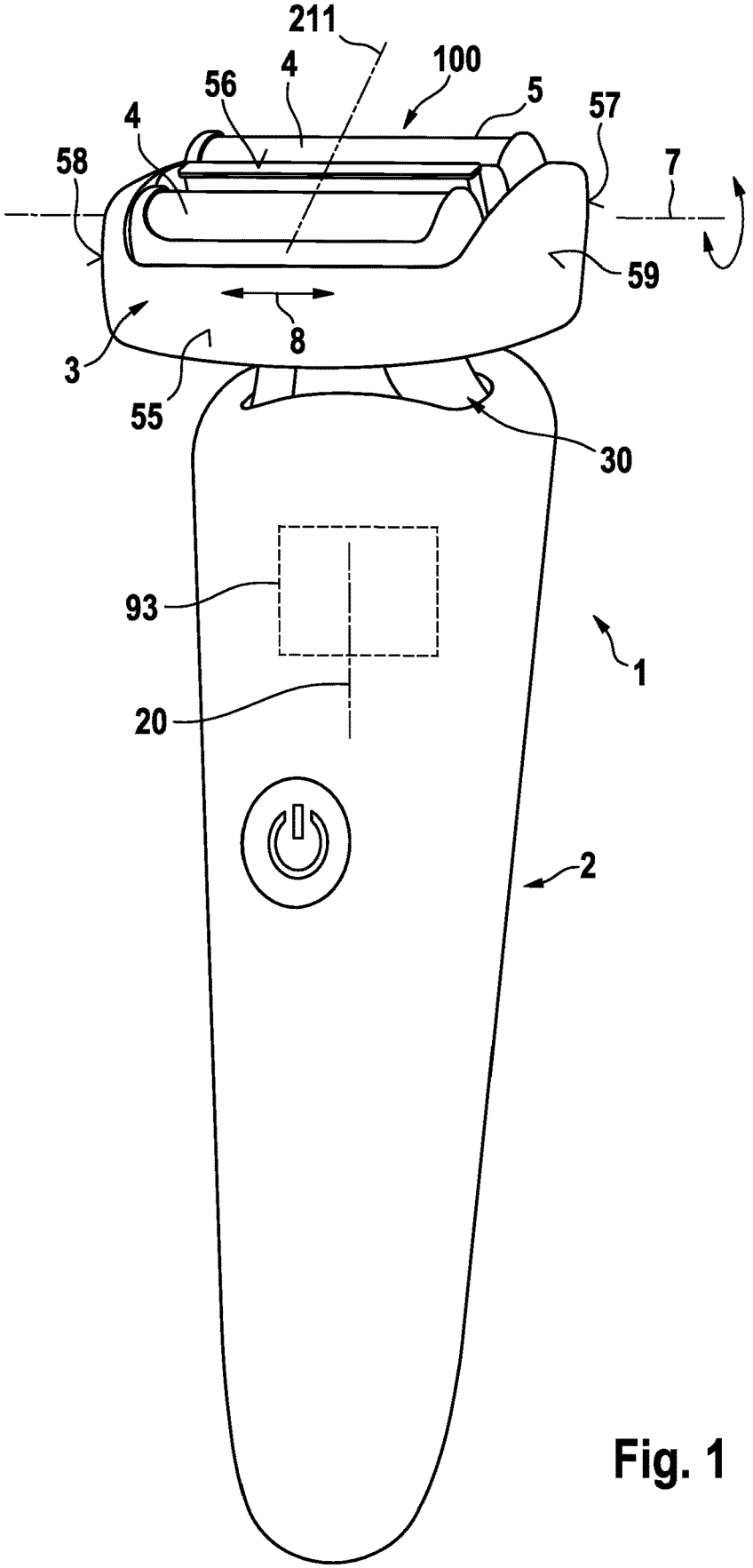
FIG. 1: a perspective view of an electric shaver with a self-adjusting shaver head, wherein the tilting and swiveling axes of the shaver head are shown in addition to the reciprocating drive axis and dive axis of the cutter element of the shaver head.

In order to achieve instantaneous play-free driving of the at least one cutter element along the cutter oscillation axis as well as allowing self-adjusting movements of the cutter element about tilting and/or swiveling axes to achieve self-adaption of the cutter element to the skin contour and compensation of misalignment of the handpiece relative to the skin contour, the drive train may dispense with any yielding oscillation bridge between the elongated drive transmitter and the cutter element, but the elongated drive transmitter may form a rigid structure extending to the cutter element and may be directly connected to the cutter element by means of a pivot joint, wherein said pivot joint may form the only axes of freedom and/or axes of movability of the cutter element relative to the elongated drive transmitter.

The pivot joint may be the only structural element or spot of the transmission train where the cutter element may move relative to the elongated drive transmitter which may form a rigid, non-yielding structure extending from the drive unit's motor to the cutter element.

To achieve a stiff transmission characteristic with low losses for the cutting movement along the cutter oscillation axis on the one hand and allow for self-adaption of the cutter element along and/or about other axes on the other hand, the said pivot joint may be adapted to be at least substantially free of any play relative to the cutter element and the drive transmitter in the direction of said cutter oscillation axis, wherein in particular the engagement of the pivot joint with the elongated drive transmitter and the cutter element may be adapted to be free of play in the direction of said cutter oscillation axis. On the other hand, the said pivot joint may be adapted to provide for movability along displacement axes other than said oscillation axis and/or provide for freedom to pivot about one or more pivot axes.

More particularly, the pivot joint connecting the rigid drive transmitter to the cutter element may slide relative to the drive transmitter and/or relative to the cutter element in the direction substantially parallel to the longitudinal axis of the drive transmitter. Thus, the cutter element may move up and down along the drive transmitter, thereby compensating for respective movements of the cutter element in the direction of the drive transmitter's longitudinal axis when slewing the shaver head and thus the cutter element about an axis that is not going through the pivot joint. For example, when the shaver head is tilted about a tilting axis extending transverse to the longitudinal axis of the drive transmitter and the oscillation axis, it may be that the tilting axis is spaced apart from the pivot joint connecting the drive transmitter to the cutter element so that the cutter element, in addition to its angular movement, moves in the direction of the drive transmitter's longitudinal axis. Such movements may be compensated by the movability of the pivot joint relative to the drive transmitter and/or relative to the cutter element in the direction of the drive transmitter's longitudinal axis. Similarly, when there are swiveling movements of the shaver head about a swivel axis extending substantially parallel to the oscillation axis, but spaced apart therefrom, the cutter elements, in addition to their angular movements due to swiveling, may also move in the direction of the drive transmitter's longitudinal axis. The swivel axis may be spaced apart from the pivot joint for different reasons, for example when there are two cutter elements between which additional functional elements such as a long hair cutter may be provided. For such multi-cutter shaver heads, the swiveling axis may extend in a plane between the two cutter elements so that the pivot joint connecting the drive transmitters to the cutter elements may be spaced apart from the swivel axis.

In addition to the aforementioned degree of freedom allowing the pivot joint to dive relative to the drive transmitter and/or relative to the cutter element in the direction of the drive transmitter's longitudinal axis, the pivot joint may be provided with an additional degree of freedom allowing for displacement of the pivot joint relative to the drive transmitter and/or relative to the cutter element in a direction substantially transverse to the longitudinal axis of the drive transmitter and substantially transverse to the oscillation axis. Such transverse degree of freedom does not impair the transmission of driving forces from the drive transmitter to the cutter element, but helps in compensating misalignments and adjusting movements of the cutter elements when swiveling the shaver head about the aforementioned swiveling axis extending parallel to the oscillation axis.

In addition to such transverse displacement of the drive transmitter relative to the cutter element in the direction of the tilting axis, the pivot joint may be rotatably mounted to the elongated drive transmitter and/or to the cutter element to allow rotation of the elongated drive transmitter relative to the cutter element about an axis of rotation substantially parallel to the longitudinal axis of the elongated drive transmitter.

The aforementioned possible displacements in the directions transverse to the cutter oscillation axis and the aforementioned possible rotation of the pivot joint exceed the usual play due to manufacturing tolerances and, more particularly, is given to such extent that misalignment of the rigid drive transmitter relative to the cutter element due to tilting and/or swiveling movements of the shaver head are compensated. For example, the possible displacements in the aforementioned first and second directions transverse to the cutter oscillation axis may amount to 25% or more, or 50% or more of the regular amplitude of the cutter element's cutting oscillation. If related to the dimensions of the cutter element, for example, the pivot joint may be configured to allow for displacement of the rigid drive pin relative to the cutter element in the direction transverse to the cutter oscillation axis of about 30% or more of 50% or more of the elongated cutter element's thickness measured transverse to the cutter oscillation axis. Such values are to be considered as examples showing that the possible displacements are far beyond usual manufacturing tolerances and play created thereby. The aforementioned directional indication 'transverse' does not necessarily mean (but nevertheless can mean, of course) exactly perpendicular in a mathematical sense, but may mean roughly perpendicular such as 90°±25° or 90°±15° or 90°±10°, for example.

The aforementioned pivot joint may form a ball-like connection element connecting the drive transmitter to the cutter element, wherein such ball-like connection element may be received rotatably and slidably in a recess in the cutter element cooperating therewith. Such ball-like connection element may rotate and/or slide relative to the cutter element. In addition or in the alternative, the aforementioned pivot joint may include a sort of cardan-type connection allowing for the aforementioned pivoting movements about the aforementioned two pivot axis and displacements in the aforementioned first and second directions transverse to the cutter oscillation axis. For example, such cardan-type connection element may support an engagement element which is slidably received in the recess in the cutter element to enable displacements along the aforementioned first and second directions. In addition or in the alternative, the pivot axes of such cardan-type joint may be received in slot-like recesses to allow for the aforementioned displacement along the first and second directions.

Depending on the type of electric shaver, the drive unit which may include a rotatory electric motor or a magnetic-type linear motor, may be accommodated within the shaver housing. In the alternative, the rotatory or linear motor may be accommodated within the shaver head. Irrespective of the type of the motor, the elongated drive transmitter may form a rigid structure extending all the distance from the motor to the cutter element.

When the motor is a rotatory electric motor, the drive transmitter may include a shaft which is rotated in a reciprocating or oscillating manner, wherein such shaft may extend substantially parallel to the longitudinal handle axis or slightly inclined thereto and/or may extend from the handle into the shaver head where said shaft may be rigidly connected to a crank arm to which at least one drive pin may be rigidly fixed. Said at least one rigid drive pin may extend substantially parallel to the axis of rotation of the aforementioned shaft and eccentrically thereto. The aforementioned crank arm eccentrically supporting the drive pin, may extend substantially perpendicular to the oscillation axis of the cutter element connected to such drive pin via the pivot joint, when considering the shaft in its neutral or intermediate position from which it oscillates into opposite directions. Due to such orientation of the crank arm, the drive pins execute a rotatory oscillation on a circular path segment which is substantially tangential to and thus, almost parallel to the oscillation axis in terms of a linear path.

The aforementioned transmitter including the shaft and the drive pin connected thereto through said crank arm, may form a rigid structure that is rigidly supported at the handle in a rotatable manner but otherwise fixed so that the elongated drive transmitter's longitudinal axis extends in a fixed orientation relative to the handle to allow only the rotatory oscillation of the shaft.

To achieve a stiff transmission characteristic and avoid transmission losses, the said elongated drive transmitter including the shaft and eccentric drive pin may have sufficient stiffness and strength and may be adapted to not bend or deform under operative loads. For example, it may be a metal pin rigidly attached to a metal shaft. In particular, the drive pin's longitudinal axis is held in a fixed orientation relative to the handle.

Depending on the configuration of the cutter element and its mounting or support structure, the elongated drive transmitter may have a length to end before or at the cutter element or to extend into an interior transmitter recess formed in said cutter element in which an end portion of said elongated drive transmitter—in particular said drive pin—is received pivotably about said pair of pivot axes transverse to the drive transmitter's longitudinal axis and displaceable in said direction substantially parallel to the drive transmitter's longitudinal axis and/or in said direction transverse to said cutter oscillation axis and transverse to said longitudinal axis of the elongated drive transmitter. An extension of the elongated drive transmitter into an interior transmitter recess may bring the position of the pivot axis close to the cutting and/or shearing surfaces of the cutter element and therefore, may reduce the length of a lever arm going from the point where forces are transmitted by the pivot joint onto the cutter element to the point where resistive forces due to cutting or shearing are applied to the cutter element. Thus, a tendency of pivoting of the cutter element due to driving forces and the lever arm thereof may be reduced.

The pivot joint between the elongated drive transmitter and the cutter element may be realized in different ways. For example, the elongated drive transmitter may be in direct engagement and/or in direct contact with body walls of the cutter element defining the aforementioned interior transmitter recess forming the pivot joint. When the elongated drive transmitter includes a rigid drive pin, said drive pin may be in direct engagement with the walls defining said interior transmitter recess in the cutter element. Optionally, the drive pin may be provided with an engagement sleeve rigidly or slidably connected to the drive pin body and engaging with said transmitter recess. Such sleeve may have a cylindrical shape seated on the drive pin and form a replacement sleeve which may be replaced due to wear and tear or may form a sliding sleeve made of an appropriate material providing for smoothly sliding engagement with the cutter element. In addition or in the alternative, such sleeve may also be provided in the body of the cutter element to form the aforementioned interior transmitter recess.

The said interior transmitter recess of the cutter element may form a slightly elongated, slot-like hole having concave sidewalls defining a gap the width of which substantially corresponds to a thickness or diameter of said elongated drive transmitter or the diameter of the head joint element attached thereto and the length of which is substantially larger than said thickness or diameter of the elongated drive transmitter or the diameter of the head joint element attached thereto, said width extending parallel to the cutter oscillation axis and said length extending transverse to the cutter oscillating axis and transverse to the longitudinal axis of the elongated drive transmitter. In particular, the elongated, slot-like hole may be adapted to receive the elongated drive transmitter substantially without play relative to the cutter oscillation axis and, on the other hand, to provide for play between the cutter element and the elongated drive transmitter relative to an axis transverse to the cutter oscillation axis and transverse to the longitudinal axis of the elongated drive transmitter. Thus, a stiff transmission characteristic relative to the cutter oscillation axis is achieved, whereas on the other hand self-adaption movements of the cutter element to the skin contour are possible and compensation of misalignment due to, for example, pivoting movement of the shaver head and/or adjusting movements of the cutter element relative to the shaver head can be achieved. The concave shape of the sidewalls defining the slot-like hole receiving the drive transmitter provides for a pivoting degree of freedom and allows for pivoting adjustment of the cutter element relative to the elongated drive transmitter about a pivot axis substantially transverse to the cutter oscillation axis and the longitudinal axis of the elongated drive transmitter.

According to another aspect, the pivot joint may include a ball- and/or block- and/or sleeve-like connector connecting an end portion of said elongated drive transmitter to the cutter element, wherein said end portion of the elongated drive transmitter can be received in said connector piece mounted to the cutter element.

Said ball-like or block-like connector may form a ball-joint piece having a substantially spherical support surface in pivotable engagement with a substantially spherical or dome-shaped or cylindrical support surface of the cutter element and having a transmitter recess receiving the elongated drive transmitter. The said spherical support surfaces on the ball-joint piece and the cutter element do not need to define a complete sphere, but may define only a portion of such sphere, for example a spherical cap or a dome-shaped bearing surface. Nevertheless, it is possible that the spherical support surface of the ball-joint piece forms almost a complete sphere or a hemisphere or more than a hemisphere.

In particular, the said spherical or dome-shaped support surfaces may be oriented and/or arranged so as to cover at least portions of the pivot joint containing and/or surrounding the cutter oscillation axis going through the pivot joint. In other words, the spherical support surfaces may be provided at least in regions of the pivot joint facing the reciprocation direction of the cutter element so as to transmit the driving forces in this direction. More particularly, the spherical support surfaces may be arranged such that the cutter oscillation axis goes perpendicularly through said spherical surfaces.

The elongated drive transmitter may be received in said ball-joint piece in different ways. According to an aspect, the transmitter recess of the connector may be adapted to prevent any movement of the block-like connector relative to the elongated transmitter piece in a direction parallel to the cutter oscillation axis.

According to a further aspect, the elongated drive transmitter may be received in said block-like connector in a slidable manner to allow sliding of the block-like connector relative to the elongated transmitter along the longitudinal axis thereof. Such slidable mounting of the block-like connector onto the drive transmitter, in particular the aforementioned drive pin, allows for compensating movements of the cutter element in a direction along the longitudinal transmitter axis even when the block-like connector may not move in such direction relative to the cutter element. A spring device or biasing device may be used to bias the connector relative to the drive pin towards the cutter element and/or into a desired engagement position where the connector engages the cooperating portion of the cutter element.

In the alternative, the said connector block also may be rigidly fixed to the elongated drive transmitter. To allow for adjusting movements of the cutter element relative to the elongated drive transmitter, the connector may move relative to the support surface of the cutter element. More particularly, the support surface of the cutter element may be configured to allow for displacement of the cutter element relative to the elongated drive transmitter in the direction transverse to the cutter oscillation axis and parallel to said longitudinal axis of the drive transmitter.

The pivot joint support surfaces of the cutter element may be formed integrally or rigidly fixed to a cutter element body of the cutter element. Such pivot joint support surfaces may be formed directly by the material of the cutter element body. In the alternative, optionally such support surfaces may be formed by an insert or a cover-layer rigidly connected to the cutter element, for example in terms of a bearing insert.

According to another aspect, the pivot joint support surface of the cutter element may be provided on a cutter element spring connected to a cutter element body and elastically biasing the cutter element body against a shear foil of the shaver head. Thus, the elongated drive transmitter drives the biasing spring structure in an oscillating manner along the aforementioned cutter oscillation axis which biasing spring structure is adapted to bias the cutter element towards a shear foil and/or towards the skin to be shaved.

In order to achieve a responsive self-adjustment of the angular position of the cutter element to the skin and to avoid collisions between the drive train for driving the cutter element and the support structure, a four-joint linkage may be provided between the shaver head and the handle to allow the shaver head to swivel and/or tilt relative to the handle, wherein said four-joint linkage includes a pair of link arms each having a head joint pivotably connecting to a shaver head part and a handle joint connecting to the handle or a base part connected to such handle. More particularly, said pair of link arms may be arranged in a standing configuration with the head joints of the link arms connecting to the shaver head part being further away from the handle than the handle joints of the link arms connecting to the handle or base part.

Contrary to a hanging or pendulum arrangement of the link arms where—when considering the shaver in an upright position with the shaver head above the handle—the upper ends of the link arms are connected to the handle and the hanging lower ends of the link arms are connected to the shaver head, such standing configuration provides for additional space that can be used for the drive train, and for a better kinematics of the shaver head support, and makes cleaning of the neck of the shaver between the handle and shaver head easier. As in such standing configuration—when considering the aforementioned upright position of the shaver—the lower end portions of the link arms are connected to the handle or base part and the upper end portions of the link arms are connected to the shaver head part, the handle or base part does not need to extend deeply into the shaver head to reach the upper ends of the link arms what considerably saves space in the region of the shaver head, thus giving more freedom and space to the drive train extending through the shaver head. In addition, the standing configuration allows for an improved shaver head kinematics giving a quicker response to pressure onto the functional surface contacting the skin contour and allowing angular adjustment of the shaver head under less contact pressure from the skin to be shaved as the standing link arms are more willing to leave its position than hanging pendulum arms. In addition, such standing link arm configuration allows for an improved arrangement of the polhode or path along which the instantaneous center of rotation moves when rotatorily displacing the shaver head.

In particular, the link arms of the four-joint linkage may be configured to define the instantaneous center of rotation moving along a path extending through and/or adjacent to said cutter element, wherein such path may have a curved shape which can be convex towards a functional side of the shaver head to be contacted with the skin to be shaved. Said path along which the instantaneous center of rotation moves when the shaver head rotates relative to the handle under the control of the four-joint linkage, is sometimes referred to as polhode or centrode. In theory, such polhode defined by the link arms of the four-joint linkage may not only define a convex curve, but a closed circle. However, when considering the working range of the shaver head's movements and rotation relative to the handle, which working range is usually limited, said path of the instantaneous center of rotation may form the aforementioned convex curve which may have its summit or vertex positioned in the region of the cutter unit in the center thereof.

Due to such path of the instantaneous center of rotation extending very close to the functional surface of the cutter element, frictional forces due to sliding of the shaver along the skin to be shaved, do not cause undesired angular movements of the shaver head as such frictional forces have only short lever arms relative to the instantaneous center of rotation. On the other hand, pressure forces onto the functional surface of the shaver head which are mainly effective transverse to or perpendicular to such functional surface make the shaver head adjust its angular position to follow the contour of the skin.

The geometry of the link arms may be chosen such that the path of the instantaneous center of rotation is only slightly curved and/or has a flat or shallow contour so that the instantaneous center of rotation stays close to the cutter element, in particular the functional surface of such cutter element, what keeps the lever arm of frictional forces small when the shaver head is moved along the skin. For example, the link arms may be configured such that the entire polhode along which the instantaneous center of rotation moves when rotating the shaver head in its working range, i.e. between its maximum end positions, may extend within the shaver head. More particularly, at least a center section of the polhode, for example ±one third of the polhode's length from the center thereof, may extend in an upper half of the shaver head, wherein such upper half means the half of the shaver head further away from the handle.

According to another aspect, said path of the instantaneous center of rotation may be adapted to extend in the region of or adjacent to the connection or joint of a drive pin of the drive train with the cutter element. At least a central portion of said path corresponding to the positions of the instantaneous center of rotation when the shaver head is in its neutral position or close thereto or only slightly rotated, may extend basically at the same height as the connecting joints of the drive train to the cutter elements or very close to a plane going through said connecting joints and perpendicular to the longitudinal handle axis. Due to the path of the instantaneous center of rotation being positioned close to the connecting joint of the drive train to the cutter element, the shaver head and thus the cutter elements remain substantially at the same height as the drive pins even when the shaver head is tilting or swiveling. Thus, such configuration of the path of the instantaneous center of rotation helps in providing for an easy connection between the drive train and the cutter element.

In order to achieve a higher stability of the shaver head in the region around its neutral position and/or to allow for easier further rotation after an initial rotation has been effected, the four-joint linkage may be configured to have the instantaneous center of rotation move further away from the diving side of the shaver head on which side the shaver head dives towards the handle when rotating about the axis defined by the four-point linkage. For example, when the shaver head is tilted or swiveled so that—when viewing the shaver head in the direction of the swivel or tilting axis—a right side end of the shaver head moves towards the handle, the instantaneous center of rotation moves towards the left side end of the shaver head. Due to such movement of the instantaneous center of rotation towards the non-diving, opposite end, the diving end of the shaver head may more easily further dive, as the surface portion of the functional surface of the shaver head contacting the skin where contacting forces or pressure have a lever arm with regard to the instantaneous center of rotation, increases. In other words, the lever arm of tilting forces increases due to the movement of the instantaneous center of rotation. For example, when the instantaneous center of rotation moves towards the left end side of the shaver head, the entire portion of the contact surface positioned on a right side of the instantaneous center of rotation has a lever arm causing the shaver head to further rotate about the instantaneous center of rotation. In other words, the contact pressure acting substantially perpendicular onto the functional surface causes a torque increasing with the degree of rotation of the shaver head as the instantaneous center of rotation moving towards the non-diving side increases the lever arm of such pressure force.

According to a further aspect, the link arms, in particular the length of the link arms and the distances between the head joints and handle joints of the link arms, may be configured such that a trajectory along which a virtual center point of the shaver head moves when rotating or tilting the shaver head, has a double pitch roof-like configuration comprising two trajectory branches diverging from each other towards the handle. The aforementioned virtual center point of the shaver head can be considered to be a point fixed with the shaver head part connected to the head joints of the link arms, and positioned in the region of the center of the cutter unit. The virtual center point is no point of the cutter element itself, as such cutter element executes additional reciprocating movements, whereas said virtual center point executes only the rotatory movements of the shaver head frame that is directly connected to the head joints of the link arms and thus, under control of the four-joint linkage.

In other words, the four-joint linkage may be configured such that the center of the cutter element dives towards the handle when the shaver head is rotated or tilted. Such trajectory of a point of the shaver head lying in the center of the cutter element allows for a natural feeling in handling the shaver and in addition allows for easy restoration of the shaver head into its neutral position. More particularly, the aforementioned double pitch roof-like configuration of the trajectory may reduce the frictional resistance between the cutter element and the shear foil when the shaver head is leaving its neutral position, since due to the aforementioned configuration of the trajectory the rotation of the shaver head relative to the handle causes no or only very small movements of the cutter element relative to the shear foil so that there is less or no resistance against rotation of the shaver head caused by the frictional resistance of the cutter element relative to the shear foil.

Said trajectory may have a rather narrow configuration with an extension limited to a central section defined by the neighborhood of a plane containing the handle's longitudinal axis. More particularly, the aforementioned two branches of the trajectory may extend from a peak point of the trajectory rather steeply and/or in a direction only slightly inclined to said central plane containing the longitudinal handle axis. For example, the trajectory may be limited to a central portion of the shaver extending from said central plane containing the longitudinal handle axis by less than ±25% or less than ±10% of the entire extension of the shaver head in a direction perpendicular to said plane. Such narrow trajectory may improve stability of the shaver head against undesired tilting due to frictional forces and gives a well-set feeling of handling to the user.

The four-point linkage may be provided to allow for tilting of the shaver head about a tilting axis that extends substantially perpendicular to the longitudinal axis of the handle and substantially perpendicular to a main axis of the shaver head, wherein such main axis of the shaver head may extend parallel to the longer side surfaces of the shaver head and/or parallel to the reciprocating axis of the cutter element and/or parallel to the longitudinal axis of the elongated cutter element itself. For example, when the shaver head has a substantially—roughly speaking—rectangular block-like shape with a pair of larger side surfaces neighboring the functional surface and a pair of smaller side surfaces neighboring the functional surface and the larger side surfaces, the aforementioned main axis may extend parallel to the larger side surfaces and the functional surface. Having defined the main axis of the shaver head in such way, the aforementioned tilting axis may be defined to extend substantially perpendicular or transverse to a plane defined by the handle's longitudinal axis and said main axis of the shaver head.

In the alternative or in addition, the aforementioned four-joint linkage also may be provided to define a swivel axis for the shaver head, which swivel axis extends substantially perpendicular to the handle's longitudinal axis and parallel to the aforementioned main axis of the shaver head.

Basically, there may be two four-joint linkages, one of which allowing for tilting of the shaver head and the other one allowing for swiveling of the shaver head about the aforementioned tilting and swiveling axes. In the alternative, however, according to an aspect, there may be provided a four-joint linkage of the aforementioned type for allowing tilting of the shaver head about the aforementioned tilting axis, whereas swiveling of the shaver head is allowed by means of a pivot axis support which may have a shaft-like axis rotatably received within a hole-like recess to define a fixed pivot axis.

The combination of the tilting support and the swiveling support may be chosen in different ways. According to an aspect, the four-joint linkage allowing for tilting of the shaver head may support a shaver head part such as a shaver head frame that may tilt relative to the handle about the tilt axis defined by the four-joint linkage and the pair of link arms thereof, wherein such tiltable shaver head part pivotably supports a further shaver head part such as a cutter element support part which may swivel about the swivel axis defined by such pivot bearing. In other words, the swivel support or swivel bearing is tiltably supported by the four-joint linkage.

In the alternative, it also would be possible to have the base part to which the link arms of the four-joint linkage are connected with their handle joints, pivotably supported relative to the handle so that said base part may swivel about the swivel axis defined by such pivot bearing. In such configuration, the four-joint linkage allowing for tilting movements of the shaver head may swivel relative to the handle.

The axis of rotation defined by the four-joint linkage—in particular the aforementioned tilting axis—substantially extends in parallel with the pivot axes of the link arms and the head/handle joints thereof. In particular, the head joints and handle joints of the link arms may be pivotably connected to the shaver head part and the handle or base part thereof, wherein all pivot axes defined by such head joints and handle joints may extend substantially parallel to each other and/or substantially perpendicular to the longitudinal axis of the elongated link arms.

When the four-joint linkage defines a tilting axis as mentioned before, such tilting axis does not necessarily extend exactly perpendicular to the longitudinal axis of the handle, but may be slightly inclined at an acute angle to the longitudinal axis of the handle. For example, such tilting axis may extend at an angle ranging from 75° to 89° relative to the longitudinal axis of the handle, wherein, however, it is also possible to have an exactly perpendicular arrangement with the tilting axis extending at an angle of 90° relative to the longitudinal axis of the handle.

Irrespective of the inclination of the tilting axis relative to the longitudinal axis of the handle, the link arms of the four-joint linkage providing for such tilting axis for the shaver head may be arranged in different positions and/or orientations. For example, the link arms may be positioned in a plane offset relative to the longitudinal axis of the handle and/or a center plane containing such longitudinal axis of the handle and/or relative to a drive train, wherein such offset from the longitudinal axis may be given in the direction of the tilting axis. In addition or in the alternative to such linear offset, the link arms may be arranged to have an angular offset, in particular they may be arranged in a common plane slightly inclined to the longitudinal axis of the handle, in particular when the tilting axis is also inclined to the longitudinal axis of the handle.

When the shaver head is supported for swiveling about a swivel axis and tilting about a tilting axis, the support structure may be configured to have the swivel axis and the tilting axis positioned closely to each other and/or close to the functional surface of the shaver head and/or close to the cutter element. In particular, the swivel axis may be defined by the support structure to extend through the cutter element and/or adjacent to the functional surface of the cutter element so that frictional surfaces transverse to the swivel axis—when moving the functional surface of the cutter head along the skin to be shaved—have no or no significant or only small lever arms relative to such swivel axis so that such frictional forces do not cause undesired swiveling of the shaver head. Such swivel axis may be defined by a pivot bearing as mentioned before what keeps the swivel axis in the desired position relative to the cutter element.

Furthermore, when the tilting axis is defined by a four-joint linkage as mentioned before, the four-joint linkage may be configured such that the instantaneous center of rotation is kept close to the swivel axis. In particular, the polhode along which the instantaneous center of rotation may move, may extend through and/or close to the swivel axis. According to an aspect, such polhode may completely extend in a hemisphere extending from said swivel axis of the shaver head towards the handle or in other words on the handle side of the swivel axis. When considering the shaver in an upright position with the shaver head above the handle, the polhode of the instantaneous center of tilting may extend below the swivel axis, in particular with a top portion of the polhode positioned close to the swivel axis and/or through the swivel axis.

For example, the link arms of the four-joint linkage may be arranged, when considering the shaver head in its neutral or non-rotated position, in a pitch roof-like or A-configuration where each of the link arms is slightly inclined towards a center plane containing the longitudinal axis of the handle and/or a center plane in the middle between the handle joints of the link arms and extending in parallel to the pivot axis going through such handle joints of the link arms. For example, the elongated link arms, with their longitudinal axis, may extend at an acute angle ranging from 5° to 45° or from 10° to 25° to such center plane, whereas, however, other configurations are possible.

According to another aspect, the distance between the handle joints of the link arms may be larger than the distance between the head joints of the link arms, wherein the difference in the distances can be chosen differently. For example, the distance between the handle joints may be in the range from 105% to 200% or from 120% to 150% of the distance between the head joints, wherein, however, such difference in distances may vary with the length of the link arms.

Irrespective of the difference in distances between the handle points and head points of the link arms, the length of the link arms may be chosen rather short so as to allow for a compact arrangement of the shaver head relative to the handle. In particular, so as to combine a compact arrangement with a high stability of the support structure, the link arms each may have a length that is shorter than the distance between the handle joints of the link arms and/or shorter than the distance between the head joints of the link arms.

According to an aspect, the at least one cutter element of the shaver head may be driven by means of a drive unit comprising an electric motor or a magnetic-type linear motor which may be accommodated within the shaver housing forming the handle. Such motor in the handle may be connected to the cutter element in the shaver head by means of a drive train comprising an elongated transmitter extending into the shaver head. For example, the drive train may include a shaft rotated by the motor in an oscillating manner, wherein such shaft may extend from the handle into the shaver head, thus passing the support structure allowing the shaver head to tilt and/or swivel relative to the handle.

Such drive train passing the support structure, in particular the aforementioned four-joint linkage, may extend in a central region of the handle and/or shaver head, wherein it may extend through a region between the aforementioned link arms of the four-joint linkage. In other words, the link arms may be positioned on opposite sides of the drive train and/or may sandwich the aforementioned drive shaft or elongated transmitter between them. In the alternative, the link arms can be provided on one side of the drive train or transmitter. For example, the link arms may be offset in the direction of the axis of rotation defined by the link arms so that the drive train passes the support structure on one side of the link arms. In addition or in the alternative, the link arms also could be offset relative to such transmitter in a direction perpendicular to the axis of rotation defined by the link arms.

So as to transform the rotatory oscillation of such shaft as mentioned before into a linear oscillation of the at least one cutter element, a crank arm may be attached to the shaft, wherein such crank arm may be positioned within the shaver head and/or may support at least one drive pin for driving the cutter element. For example, such drive pin may extend substantially parallel to the shaft and may be fixedly attached to the crank arm to extend eccentric with regard to the shaft axis. When the crank arm, in its neutral position, extends substantially perpendicular to the desired linear oscillation of the cutter element, such drive pin is moved along a curved path tangential to the desired cutter element oscillation and thus, executes a nearly linear oscillation.

Due to the aforementioned standing arrangement of the link arms of the four-joint linkage, there is enough space in the region of the shaver head for such transmitter structure, wherein the rotatorily oscillating shaft may extend between the link arms.

These and other features become more apparent from the examples shown in the drawings. As can be seen from FIG. 1, shaver 1 may have a shaver housing forming a handle 2 for holding the shaver, which handle may have different shapes such as—roughly speaking—a substantially cylindrical shape or box shape or bone shape allowing for ergonomically grabbing or holding the shaver, wherein such shaver handle 2 has a longitudinal axis 20 due to the elongated shape of the handle, cf. FIG. 1.

On one end of the handle 2, a shaver head 3 is attached to the handle 2, wherein the shaver head 3 may be slewably supported about a swiveling axis 7 and about a tilting axis 211 which swiveling and tilting axes 7 and 211 may extend substantially perpendicular to each other and perpendicular to the aforementioned longitudinal handle axis 20.

When considering a main axis 40 of the shaver head 3, the swivel axis 7 may extend parallel to such main axis 40, whereas the tilting axis 211 may extend transverse to such main axis 40. Such main axis 40 may be considered to extend in parallel to the larger side surfaces 55 and 57 of the shaver head 3 and/or in parallel with a longitudinal axis of the elongated cutter elements 4 and/or substantially perpendicular to the longitudinal handle axis 20. As can be seen from FIG. 1, the shaver head 3 may have a—roughly speaking—substantially rectangular box-like shape with a pair of larger side surfaces 55 and 57 arranged on opposite sides of the functional surface 56 which is facing away from handle 2. The shaver head 3 further has two smaller side surfaces 58 and 59 neighboring the aforementioned larger side surfaces 55 and 57 and the functional surface 56.

The shaver head 3 may include a pair of elongated cutter units 100 each having a cutter element 4 that can be driven in a reciprocating manner along reciprocating axis 8 which may extend parallel to the aforementioned main axis 40. It also would be possible the shaver head includes only one or three or more than three such cutter elements. Said cutter elements 4 may cooperate with and reciprocate under shear foils 5 covering said cutter elements 4. In addition to such cutter elements 4, the shaver head 3 may further include other functional elements such as a long hair cutter which may be positioned between two of the aforementioned cutter elements 4, and/or a cooling element and/or a lubricating element. The cutter reciprocating axis 8 extends transverse to said tilting axis 211.

The said cutter elements 4 may be supported movably relative to the shaver head 3 or, more particularly, relative to a shaver head frame 6 such that, on the one hand, the cutter elements 4 may swivel and tilt together with the shaver head 3 about swiveling and tilting axes 7 and 211 and, on the other hand, the cutter elements 4 may oscillate along a cutting or reciprocating axis 8 relative to the shaver head frame 6, wherein said reciprocating axis 8 may extend parallel to the longitudinal axis of the elongated cutter elements 4. In addition to these degrees of freedom, the cutter elements 4 may be movable relative to the shaver head frame 6 along and/or about additional axes. For example, the cutter elements 4 may dive into the shaver head 3, i.e. displaced along an axis substantially parallel to the longitudinal handle axis 20 when the shaver head 3 is in a position aligned therewith.

As can be seen from FIGS. 2 to 7, each cutter element 4 can be driven in said oscillating manner by means of an elongated drive transmitter 9 extending from the shaver housing 2 into the shaver head 3 up to the cutter element 4. Such elongated drive transmitter 9 may include a rigid shaft 90 extending from the interior of the shaver housing or handle 2 to the exterior of the handle 2, that means through an outer shell of the shaver housing, into shaver head 3, where the drive unit may include a motor 93 accommodated within the shaver housing to rotate said shaft 90 in an oscillating manner. Such motor 93 may be a rotatory electric motor connected to the shaft 90 in a suitable manner, for example via a crank mechanism transforming rotation of a motor shaft into rotatory oscillation of shaft 90.

The shaft 90, with its longitudinal axis, is held in a fixed orientation relative to the shaver housing 2, in particular substantially parallel to the longitudinal shaver housing axis 20 or slightly inclined thereto.

Figure 2:
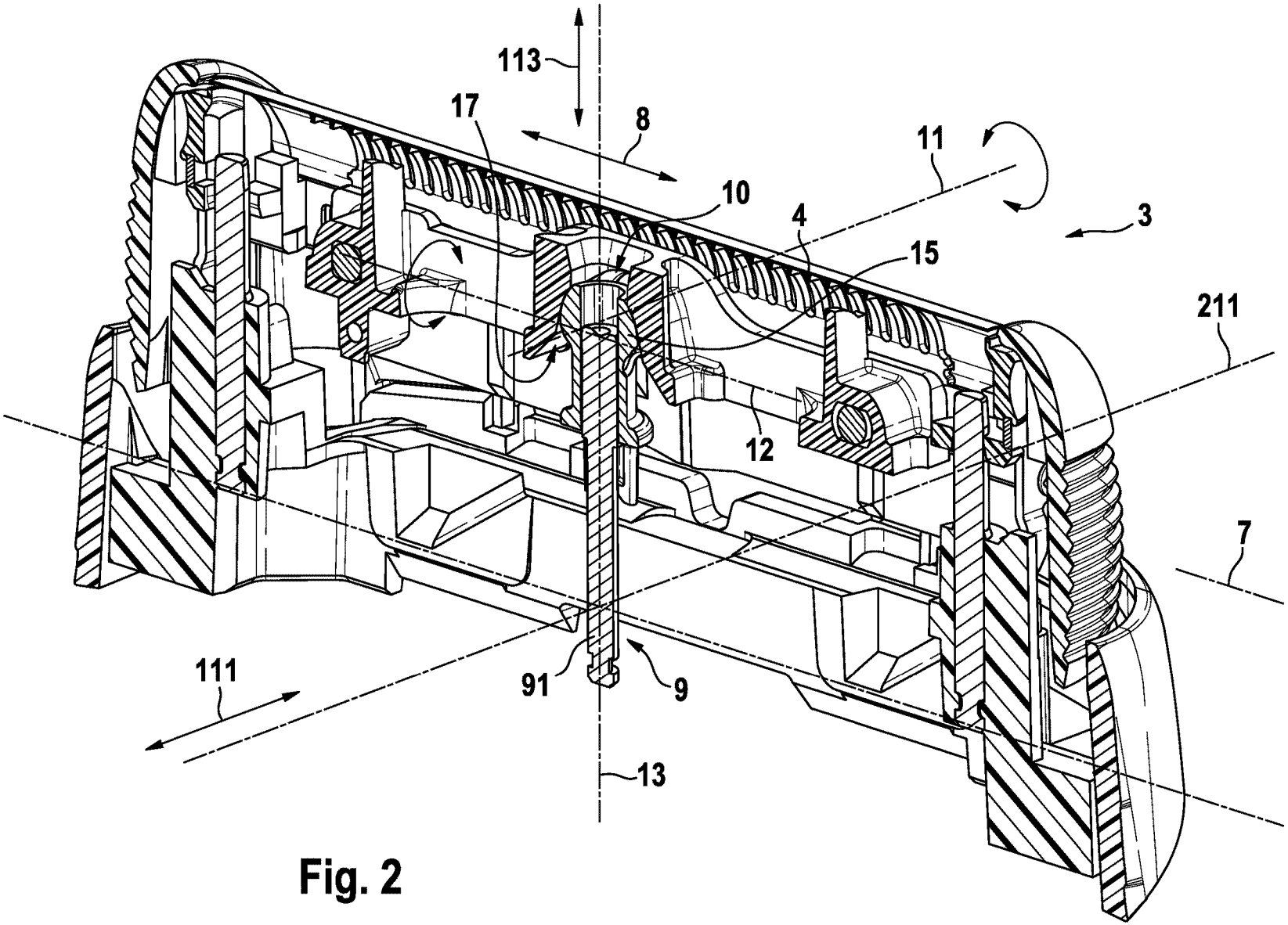
FIG. 2: shows a ball-like pivot joint coupling the elongated drive transmitter of the drive unit to the cutter element in a perspective, cross-sectional view with the cross-section having been taken in a cross-sectional plane parallel to the oscillation movement of the cutter element and containing a drive pin of the elongated drive transmitter.
Figure 7:
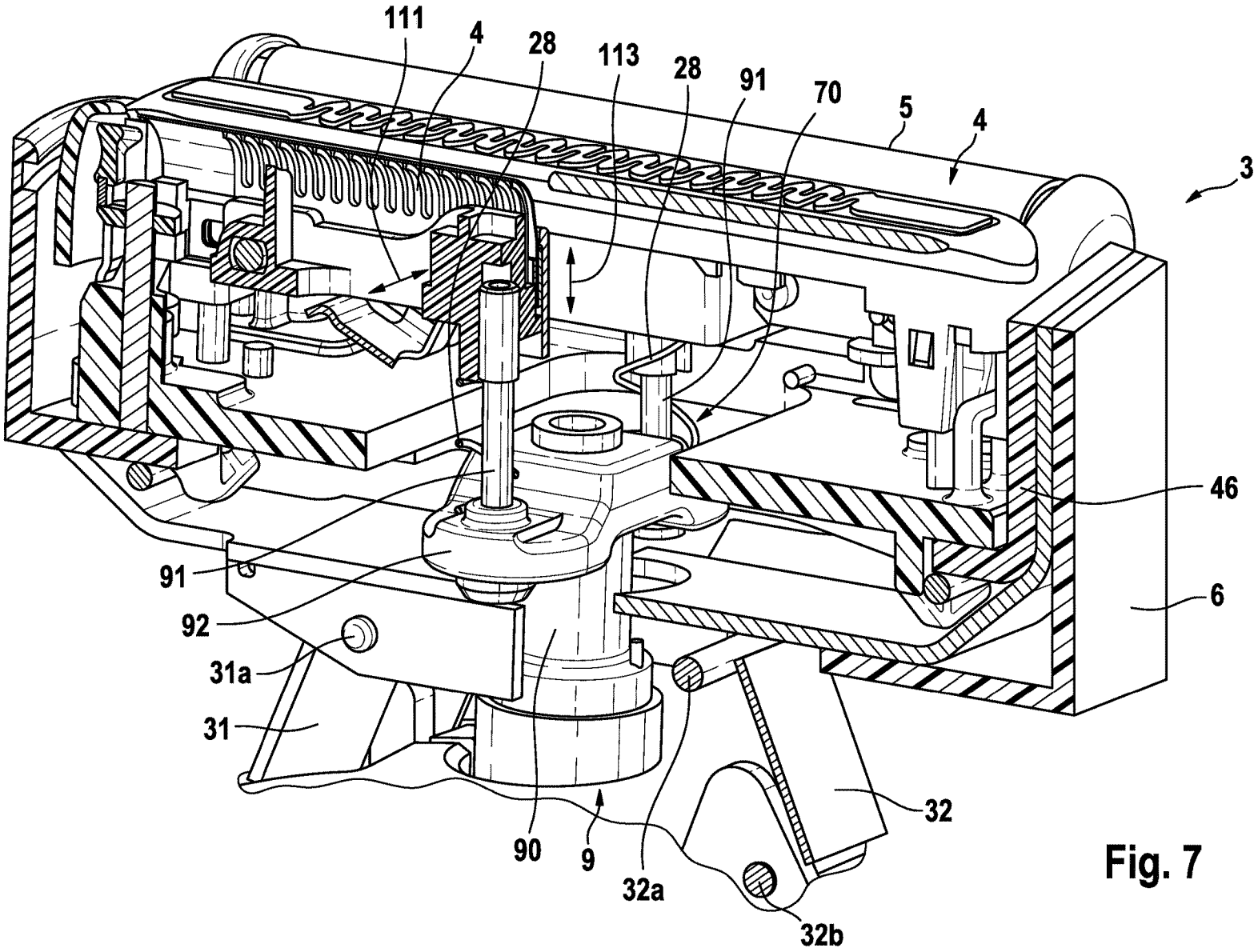
FIG. 7: a perspective cross-sectional view of the shaver head and the support structure thereof, showing the drive train extending from the handle through the support structure into the shaver head so as to drive the cutter elements in a reciprocating manner, wherein a pair of drive pins are shown rigidly fixed to crank arms extending from a shaft portion of the elongated transmitter to transform rotatory oscillation of the shaft portion into linear oscillation of the cutter elements.

Although FIG. 2 shows only one drive pin 91, it is clear from FIG. 2, that there may be two drive pins when there are two cutter elements 4, such elongated drive pins 91 extending in parallel to each other, cf. FIG. 7, or more than two drive pins 91 when there are more than two cutter elements 4.

Figure 4:
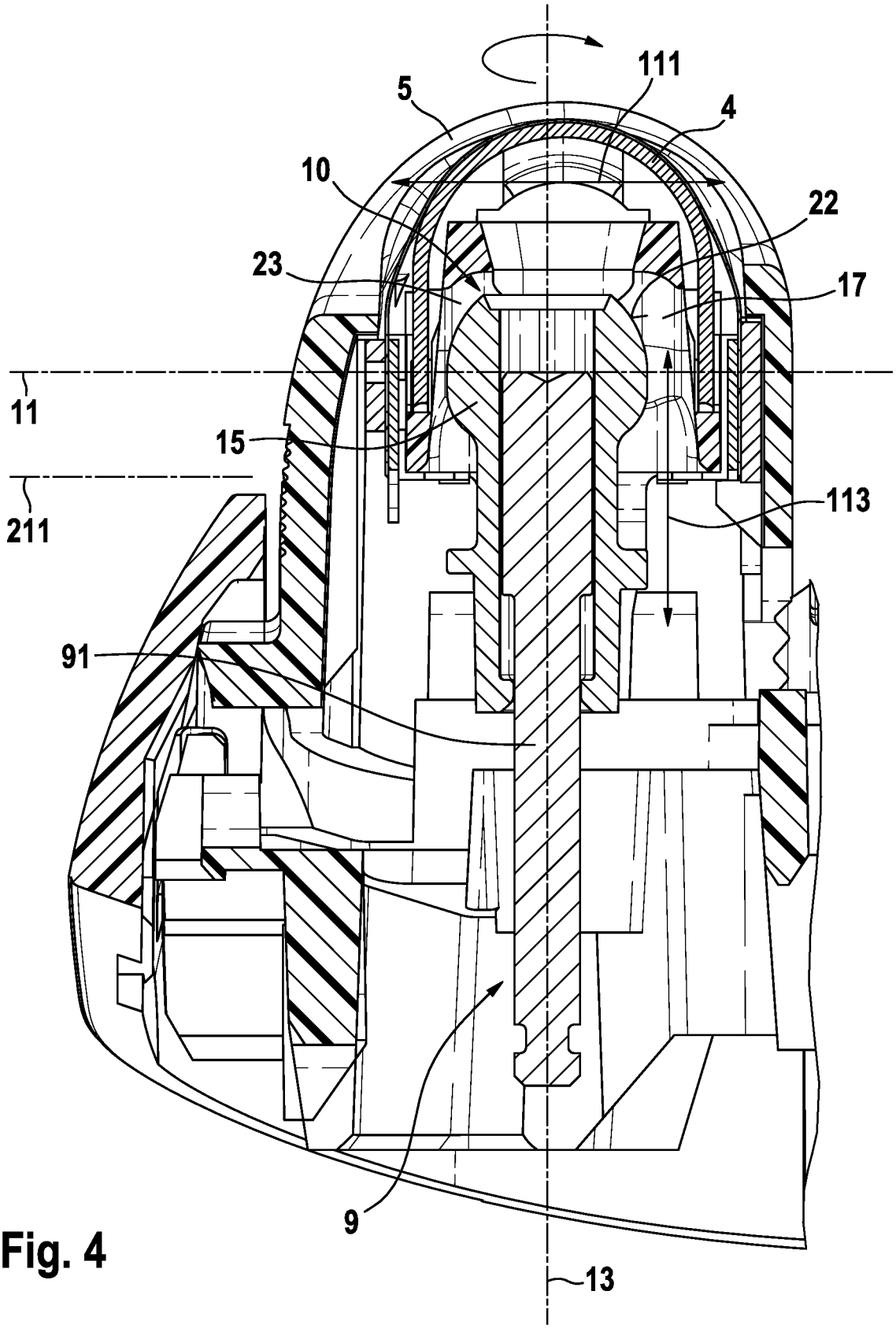
FIG. 4: shows a partial cross-sectional view of the shaver head including the ball-like pivot joint in a plane containing the elongated drive transmitter and perpendicular to the axis of oscillation.
Figure 5:
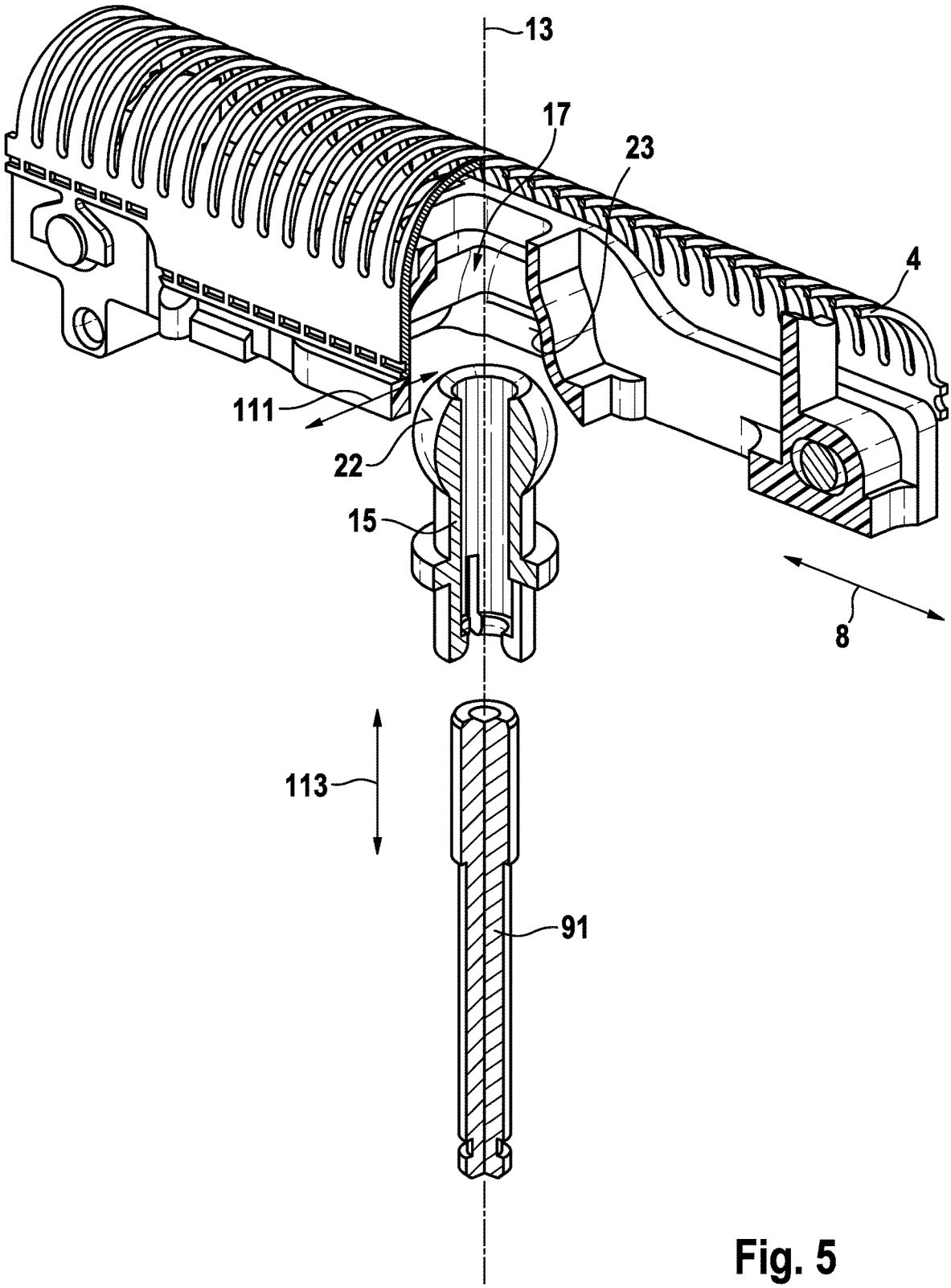
FIG. 5: shows a perspective, partially cross-sectional explosion view of the pivot joint, the drive pin of the drive transmitter and the cutter element.
Figure 6:
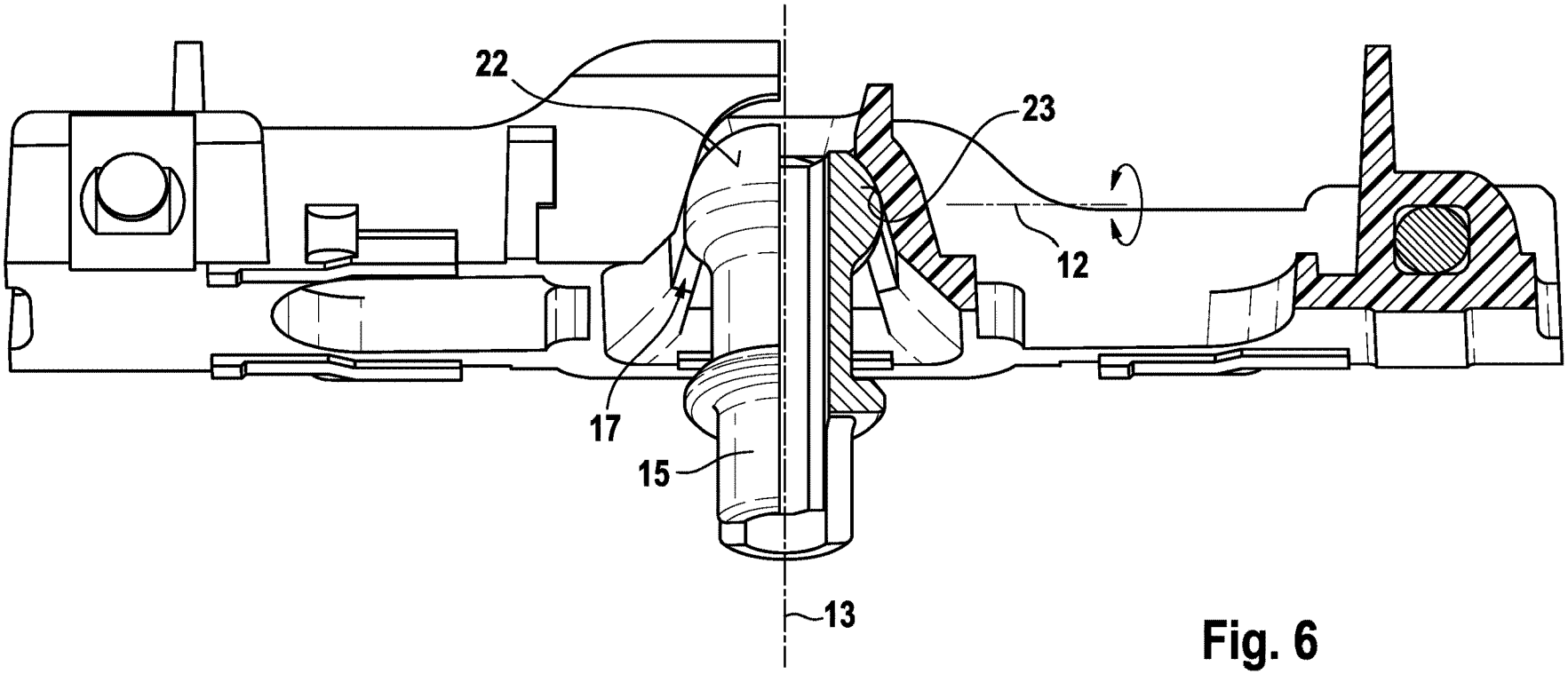
FIG. 6: shows a perspective, partially cross-sectional view of the pivot joint of the drive pin in engagement with the cutter element.

The drive pins 91 are each driven by the aforementioned shaft 90 to oscillate uniaxially relative to the shaver head 3 in a direction substantially parallel to the longitudinal extension of the elongated cutter elements 4, cf. FIGS. 4 and 5. More particularly, due to the rotatory oscillation of the shaft 90 and the crank arm 92, said drive pins 91 execute an oscillation along a circular path. However, as the crank arm 92 extends in a direction substantially perpendicular to the oscillation axis of the cutter elements 4—at least when considering a neutral or intermediate position of the shaft 90 and crank arm 92 from which the crank arm 92 rotatorily oscillates into opposite directions back and forth—, the segment of the circular path along which the drive pins 91 oscillate is oriented tangential to the oscillation axis 8. As the amplitude of the rotatory oscillation is limited, said segment of the circular path may be considered almost parallel to the oscillation axis 8 and/or almost linear and parallel to the oscillation axis 8.

The entire drive transmitter 9 including the shaft 90 and drive pins 91 may extend from the handle 2 into the cutter element 4 so that the projecting end of the elongated drive transmitter 9 in terms of its drive pin 91 extends within an interior space provided in the cutter element 4.

Said entire drive transmitter 9 including the shaft 90, the crank element 92 and the drive pins 91 form a rigid structure which is rotatably, but otherwise rigidly supported so that the longitudinal axis 13 defined by each drive pin 91 extends in a fixed orientation relative to the handle 2. Such longitudinal axis 13 may be substantially parallel to the handle's longitudinal axis 20 or inclined thereto at an acute angle.

As can be seen from FIGS. 2 to 5, the drive pin 91 of elongated drive transmitter 9 is coupled to the cutter element 4 by means of a pivot joint 10 which may include a block-shaped or sleeve-like connector 15 forming a ball-joint piece engaging with the cutter element 4. Said ball-joint piece may be a hard plastic element or made from other resistive bearing materials such as metal. The said connector 15 directly connects an end portion of the elongated drive transmitter 9 to the cutter element 4, wherein said end portion of the elongated drive transmitter 9 may be received in said connector piece 15 mounted to the cutter element 4.

Figure 3:
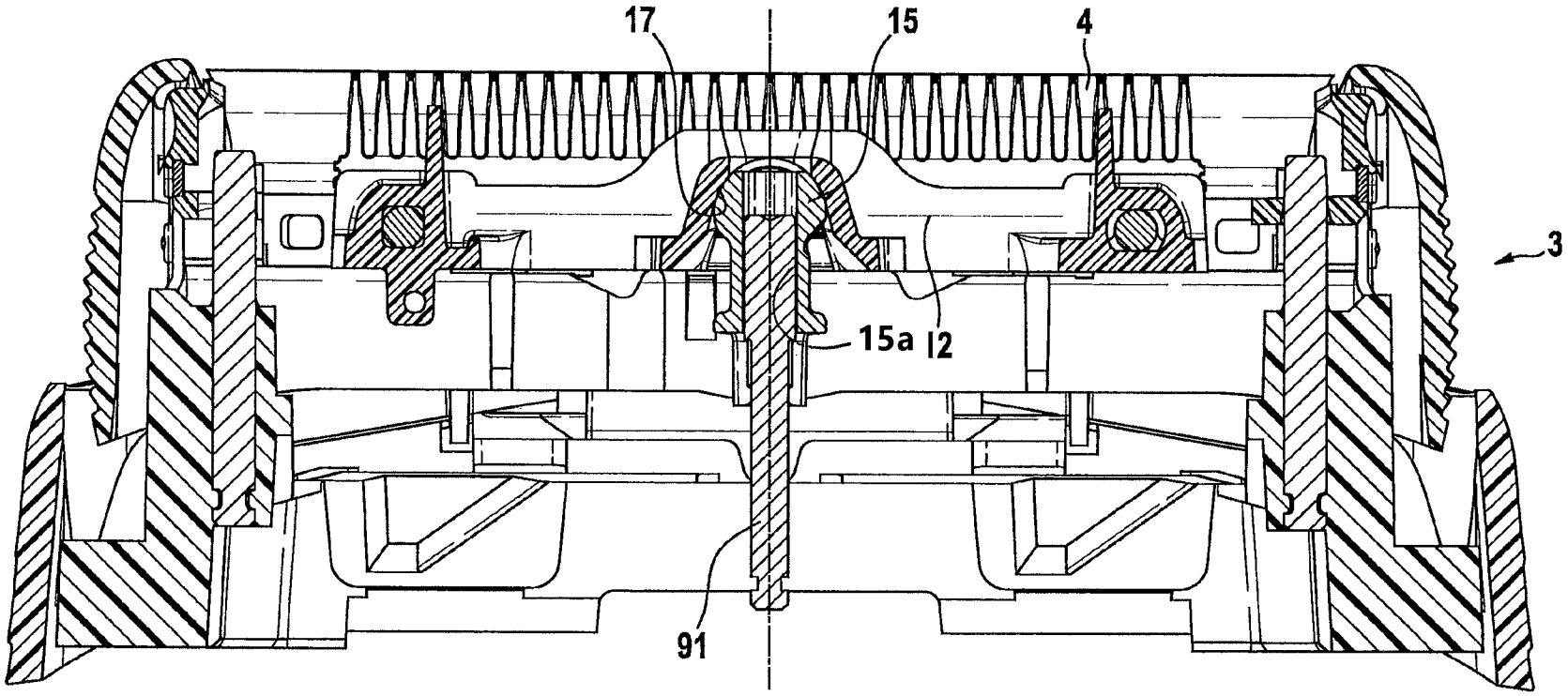
FIG. 3: shows the ball-like pivot connection between the elongated drive transmitter and the cutter element in a cross-sectional view of the pivot joint in a cross-sectional plane containing the elongated drive transmitter and parallel to the oscillation axis.

As can be seen from FIG. 3, the connector 15 may have a recess 15A that may be formed as a hole allowing to slide the connector 15 onto the drive pin 91 of the elongated drive transmitter 9 along the longitudinal axis thereof.

The connector 15 can be provided with a spherical support surface 22 which may form a spherical cap or a hemisphere or almost a complete sphere. A transmitter recess 17 of the cutter element 4 is provided with a corresponding spherical or dome-shaped or cylindrical or rounded support surface 23 cooperating and engaging with the spherical support surface 22 of the ball joint piece mounted on the drive pin 91 of elongated drive transmitter 9. As can be seen from FIGS. 4 and 5, the spherical support surface 22 of the connector 15 may be formed convex or as an outer surface, whereas the support surface 23 of the cutter element 4 may be formed concave or as an inner support surface. Basically, a contrary configuration with the connector's support surface 22 being concave and the cutter element's support surface 23 being convex is possible. Due to the dimensions of the cutter element 4 and the drive pin 91 of elongated drive transmitter 9, the aforementioned configuration with convex support surface 22 on the drive transmitter side and the concave support surface on the cutter element side allows for a more space-saving, compact configuration.

The said support surface 23 of the cutter element 4 may be formed directly by body walls of the cutter element. In the alternative, the cutter element may include a support or bearing insert or attachment which is fixedly attached to the cutter element 4 and which forms said support surface 23.

The said spherical and/or dome-shaped or rounded support surfaces 22 and 23 snuggly fit onto each other so that the connector 15 is held at the cutter element 4 without play, at least in the direction of the cutter oscillation axis 8 along which the cutter element 4 is driven in an oscillating manner. More particularly, the connector 15, due to the spherical or rounded support surfaces 22 and 23, may pivot relative to the cutter element 4 about pivot axes 11 and 12 extending perpendicular to each other and transverse to the longitudinal axis 13 of the drive pin 91 of elongated driver transmitter 9. The said pivot axes 11, 12 substantially extend through a center portion of the head of connector 15, more particularly through the center of curvatures of the spherical and/or dome-shaped and/or rounded support surfaces 22 and 23, cf. FIGS. 2, 4 and 14.

In a direction substantially parallel to the aforementioned cutter oscillation axis 8, the elongated drive transmitter 9 is rigidly, undisplaceably received within the transmitter recess 17 of connector 15 and thus, the drive pin 91 of elongated drive transmitter 9 is exactly held in position relative to the cutter element 4. In other words, along the cutter oscillation axis 8, no relative movement of the cutter element 4 to the elongated drive transmitter 9 is possible and the cutter element 4 instantaneously follows any movement of the elongated drive transmitter 9 in said direction of the cutter oscillation axis 8 without play.

In other directions than said oscillation axis 8, there are relative movements possible. In particular, the pivot joint 10 is configured to allow for relative movements of the cutter element 4 relative to the drive pin 91 in a direction 113 of the longitudinal axis 13 thereof so that the cutter element 4 may dive along the drive pin 91. Such displacement substantially along the drive pin's longitudinal axis 13 may be achieved by means of a slidable connection of the connector 15 to the drive pin 91. In addition or in the alternative, the head section of connector 15 could be slidably received in the recess of the cutter element 4 what could be achieved by forming the support surface 23 with a sort of cylindrical portion receiving the ball-shaped or spherical support surface 22 of the connector 15 so that the connector 15 may slide in such cylindrical portion which may have a circular cross-section or an oval cross-section to allow additional relative displacement in a direction perpendicular to the axis of oscillation 8 and transverse to the longitudinal axis of drive pin 91. However, as mentioned before, the connector 15 may slide along drive pin 91 to allow the cutter element 4 to dive relative to the drive pin 91 with the spherical support surface 22 of the connector 15 being in engagement with a dome-shaped support surface 23 of the cutter element 4, wherein a spring device or biasing device may be provided to urge the spherical support surface of the connector 15 towards and into engagement with the dome-shaped support surface of the cutter element 4.

Figure 14:
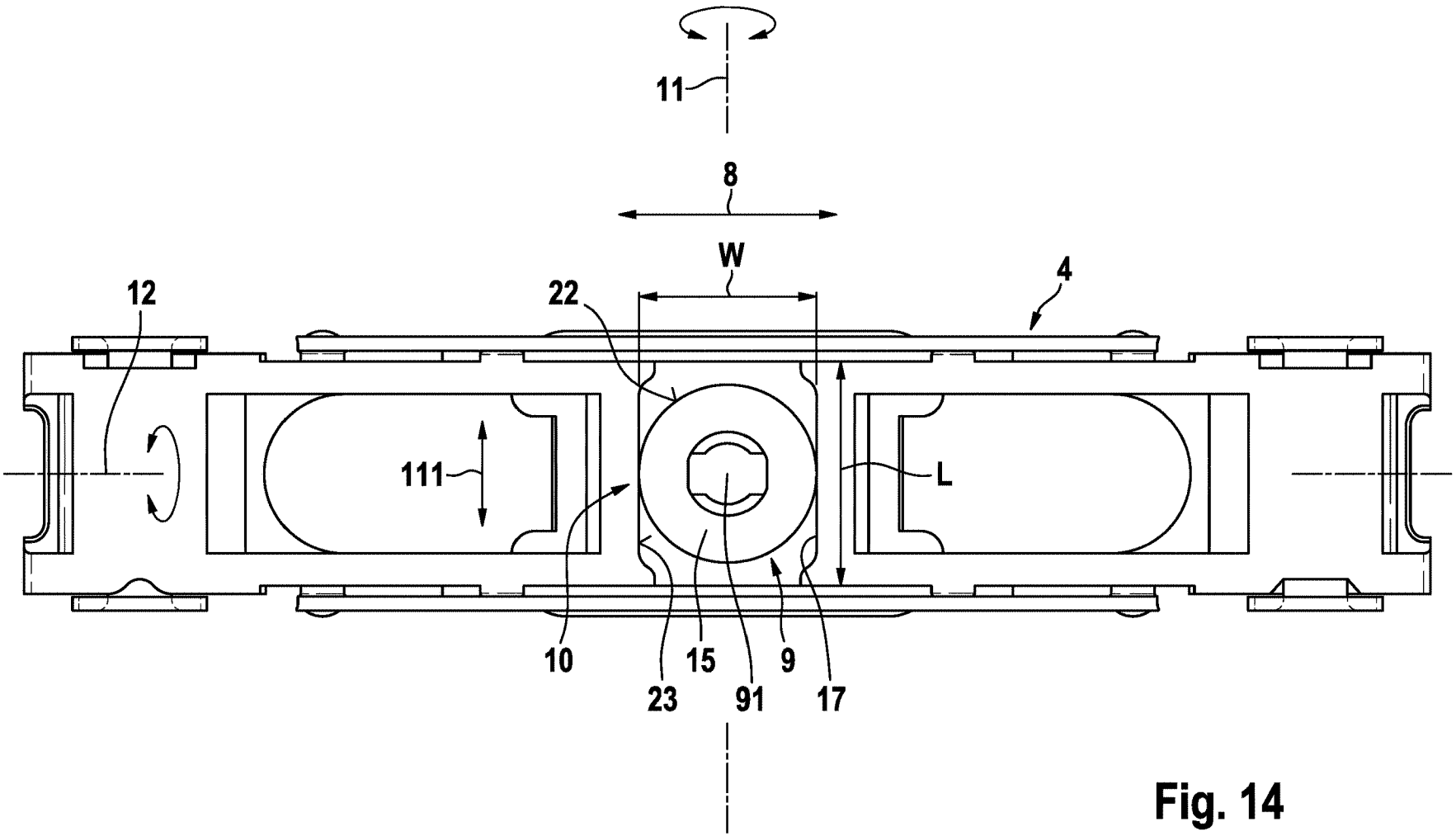
FIG. 14: a cross-sectional view of the cutter unit in a cross-sectional plane perpendicular to the longitudinal axis of the elongated drive pin, wherein the engagement of the drive joint with the recess in the cutter element and the slot-like configuration of said recess allowing displacements transverse to the cutter oscillation axis are shown.

In a direction 111 transverse to said cutter oscillation axis 8 and transverse to the longitudinal axis 13 of the drive pin 91 as of elongated drive transmitter 9, there can be play and displacement, and the elongated drive transmitter 9 may move relative to the cutter element 4. Such degree of freedom of the cutter element 4 relative to the elongated drive transmitter 9 in the aforementioned transverse direction 111, can be achieved by means of the elongated, slot-like contour of the transmitter recess 17 formed in the cutter element 4, wherein such contour may have a dome-shaped roof section engaging the spherical support surface 22 of connector 15. As shown by FIG. 14, the length L of the slot-like transmitter recess 17 is considerably larger than the diameter or thickness of the elongated drive transmitter 9. For example, the length L of the slot-like transmitter recess 17 may be at least 150% of the thickness of the elongated drive transmitter 9, wherein it is also possible to have a slot length of 200% or 300% or more of the thickness of said elongated drive transmitter 9.

As can be seen from FIG. 14, the width W of said elongated slot-like hole of the transmitter recess 17 more or less exactly corresponds to the thickness of the drive transmitter 9, more particularly to the thickness of the connector 15 on drive pin 91 such that the elongated drive transmitter 9 may move only along the length direction of said slot.

Figure 15:
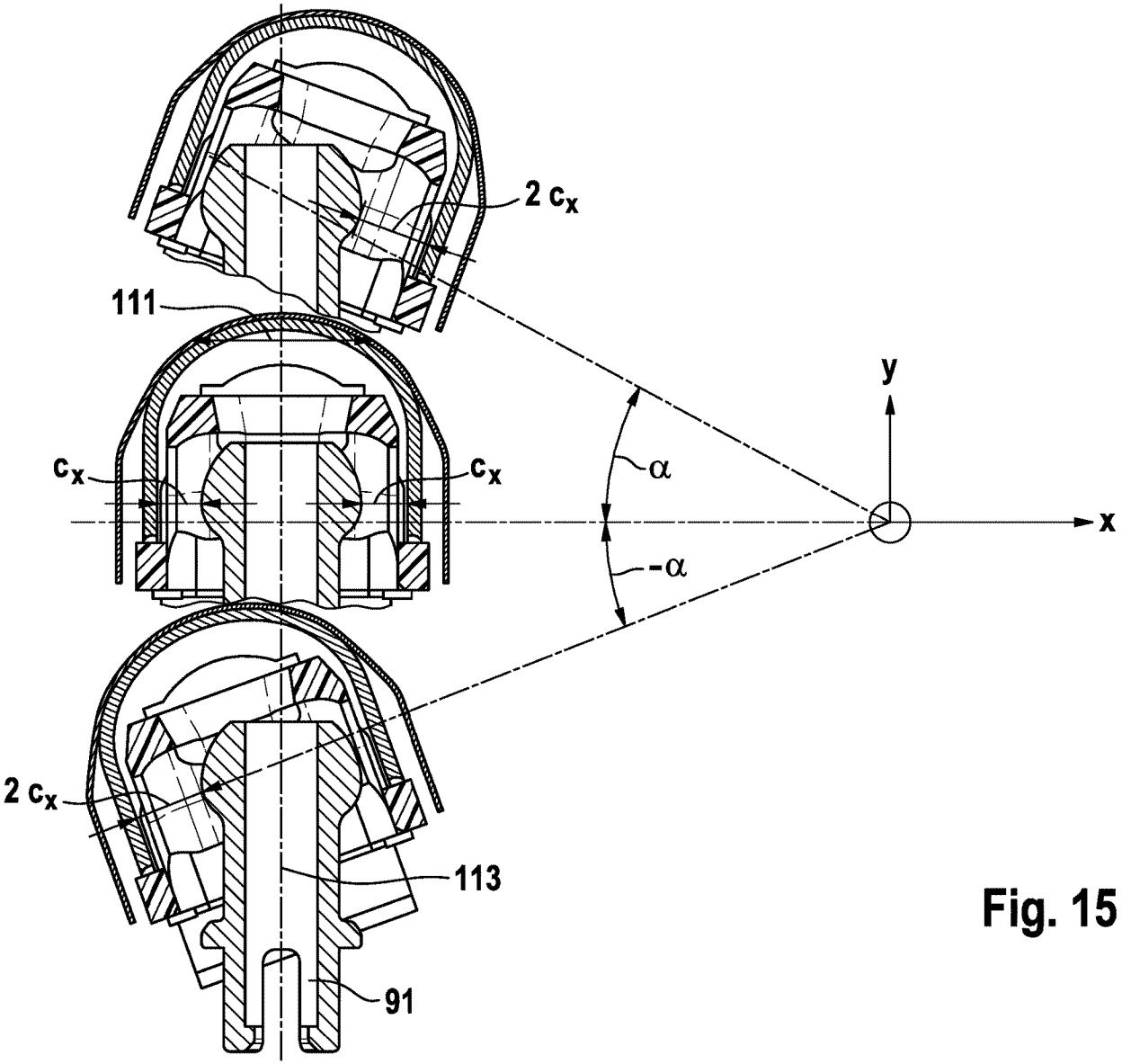
FIG. 15: a schematic cross-sectional view of a cutter element and the drive pin connected thereto in a cross-sectional plane perpendicular to the swivel axis, wherein the cutter element is shown in three different angular positions which are reached when swiveling the shaver head relative to the handle, thereby illustrating the transverse displacement of the pivot joint during swiveling.

The transverse displacement of the drive pin 91 relative to the cutter element 4 is further illustrated by FIG. 15 showing the cutter element 4 in three different angular positions which are reached when swiveling the shaver head 3 relative to handle 2 about swivel axis 7. As shown by FIG. 15, the swivel angle a may be, for example, ±5° or ±10° or ±15° or may range from ±5° to ±15°. Due to the position of the swivel axis 7 spaced apart from the pivot joint 10—as it may be the case when the swivel axis 7 is positioned between a pair of cutter units 100, for example—the cutter element 4 is displaced relative to the pivot joint 10 in a direction 111 transverse to the drive pin's longitudinal axis 13 and transverse to the swivel axis 7. In FIG. 15, reference $c_x$ designates the clearance in such transverse direction 111 as provided by the slot-like transmitter recess 17 and the length L thereof. Such clearance $c_x$ may range from ±0.7 mm to 1 mm or from ±0.7 mm to ±1.2 mm, thus in total ranging from 1 mm to 2.4 mm. In addition or in the alternative to the transverse displacement caused by swiveling movements as shown by FIG. 15, similar transverse movements in the direction 111 may also be caused by the circular path of reciprocation of the drive pin 91 which does not exactly execute a linear oscillation, but executes a rotatory oscillation about shaft 90, as it is clear from FIG. 7.

As illustrated by the arrow 113 in FIG. 4, the connection or pivot joint 10 connecting the drive pin 91 to the cutter element 4 is configured such that the cutter element 4 may dive relative to the drive pin 91 along the longitudinal axis thereof, and may rotate relative to the drive pin 91 about the longitudinal axis 13 thereof and, as indicated by arrow 111, may slide in a direction transverse to the drive pin 91 and the oscillation axis 8. On the other hand, said connection or pivot joint 10 is configured such that there is no play and no relative movement in the direction of oscillation axis 8.

Figure 13:
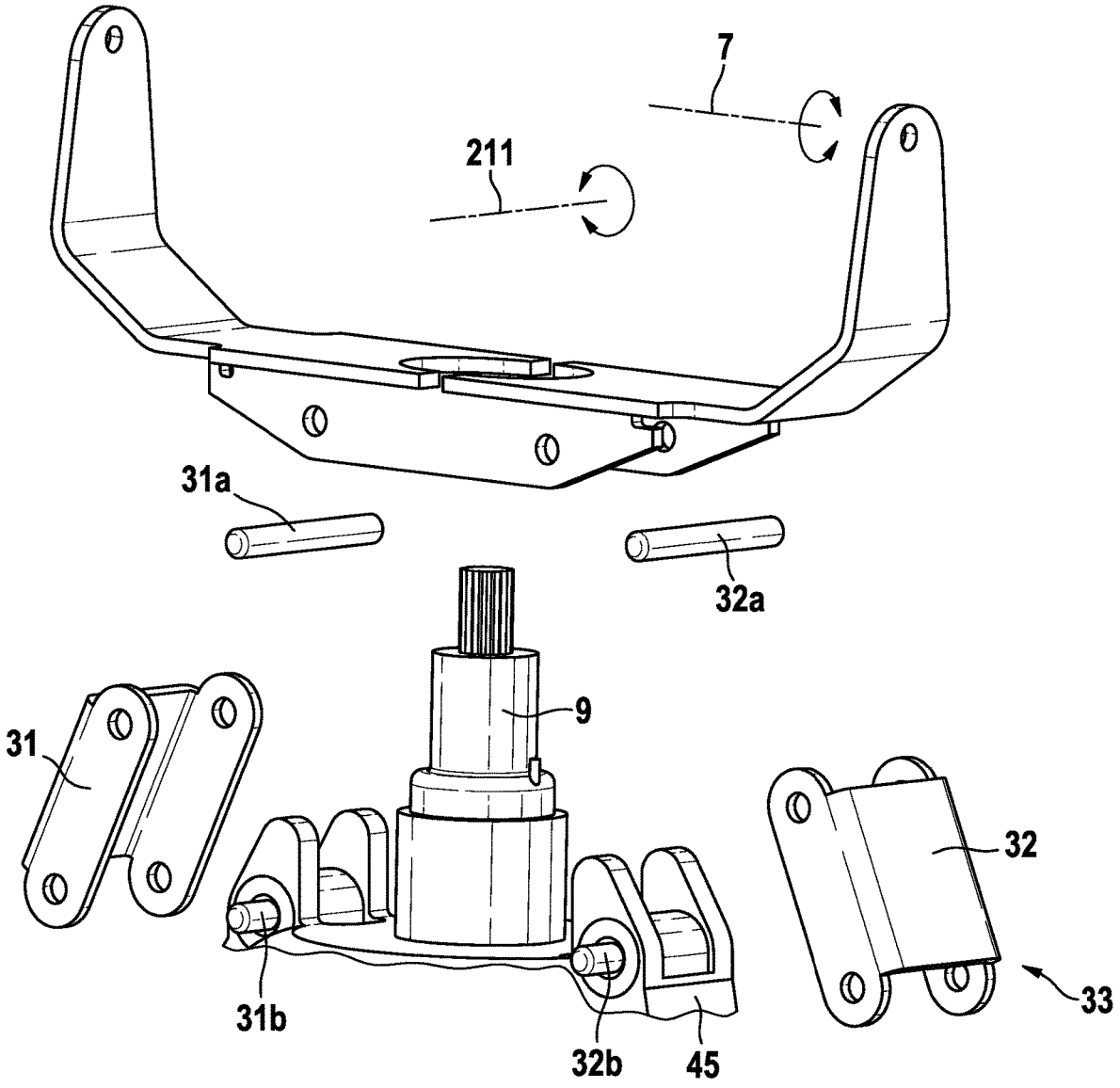
FIG. 13: a perspective explosion view of the four-point linkage of the support structure for the shaver head.

As can be seen from FIGS. **8*a*-8*b* and 9, the shaver head 3 is supported onto the handle 2 by means of a support structure 30 which may include a four-joint linkage 33 which may comprise a pair of link arms 31 and 32 that may pivot about parallel axes. Such link arms 31 and 32 may have a bar-shaped or a frame-like structure including a U-shaped cross-section as it is shown in FIG. 13**.

Said link arms 31 and 32 are arranged in an upright, standing configuration where the end portions of those link arms 31 and 32 connected to the shaver head 3 are further away from the handle 2 than the opposite end portions of those link arms 31 and 32 connected to the handle 2 or a base part 45 connected to such handle 2. In other words, when considering the shaver 1 in an upright position with the shaver head 3 above the handle 2, upper end portions of the link arms 31 and 32 are connected to a shaver head part, whereas lower end portions of the link arms 31 and 32 are connected to the handle 2 or a base part mounted thereon.

In a neutral or non-tilted position of the shaver head 3 where the main axis 40 of shaver head 3 extends substantially perpendicular to the longitudinal handle axis 20, the link arms 31 and 32 may be arranged symmetrical with regard to a center plane containing the longitudinal handle axis 20, cf. FIG. 8 (*a*). More particularly, the link arms 31 and 32 may be inclined relative to such center plane at an acute angle.

Figure 8A:
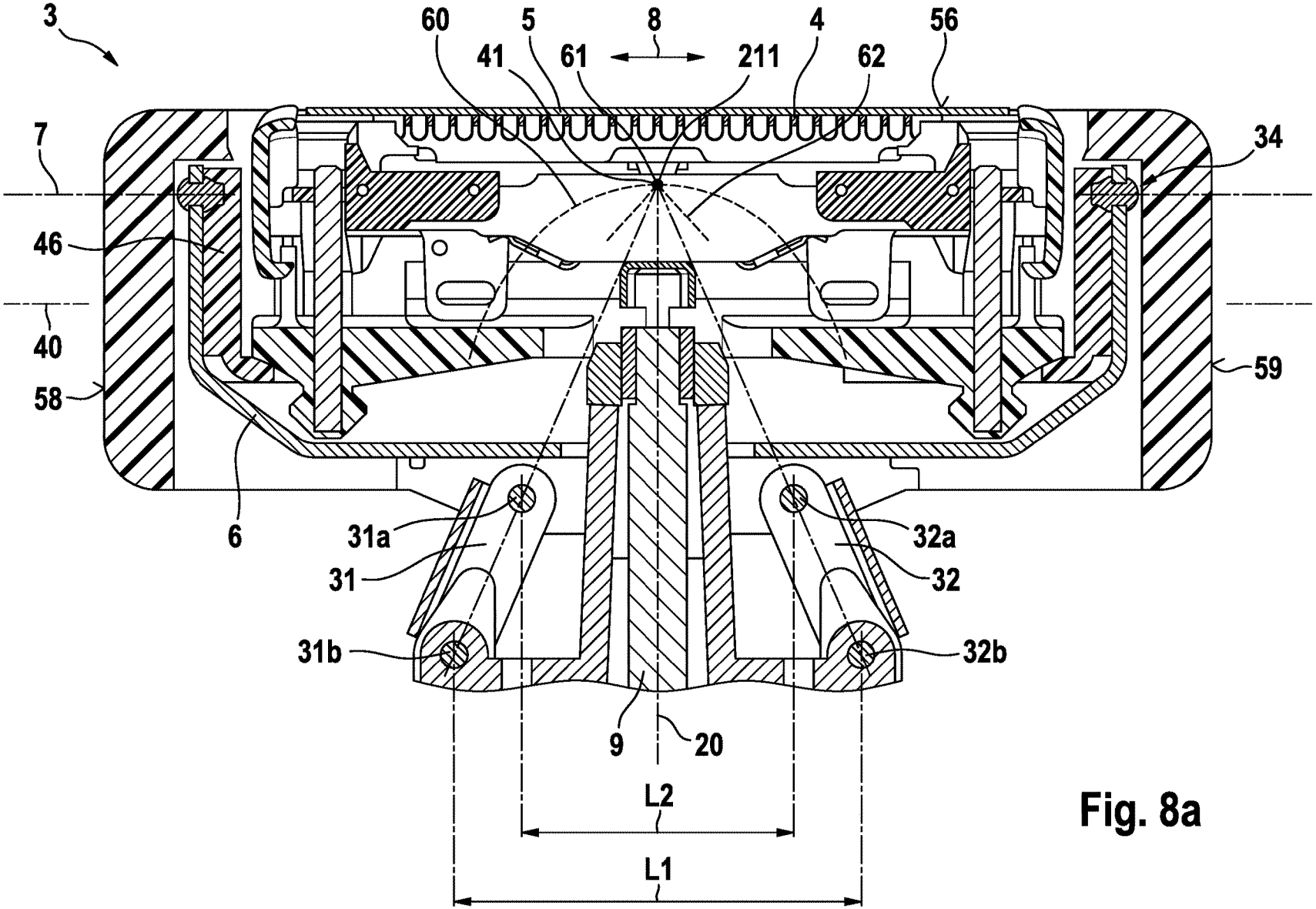
FIG. 8*a*: a cross-sectional view of the shaver head and the support structure thereof, wherein partial view shows the shaver head in a neutral or not tilted position with the link arms of the support structure being symmetrical to and slightly inclined to a middle plane containing the longitudinal axis of the shaver.
Figure 8B:
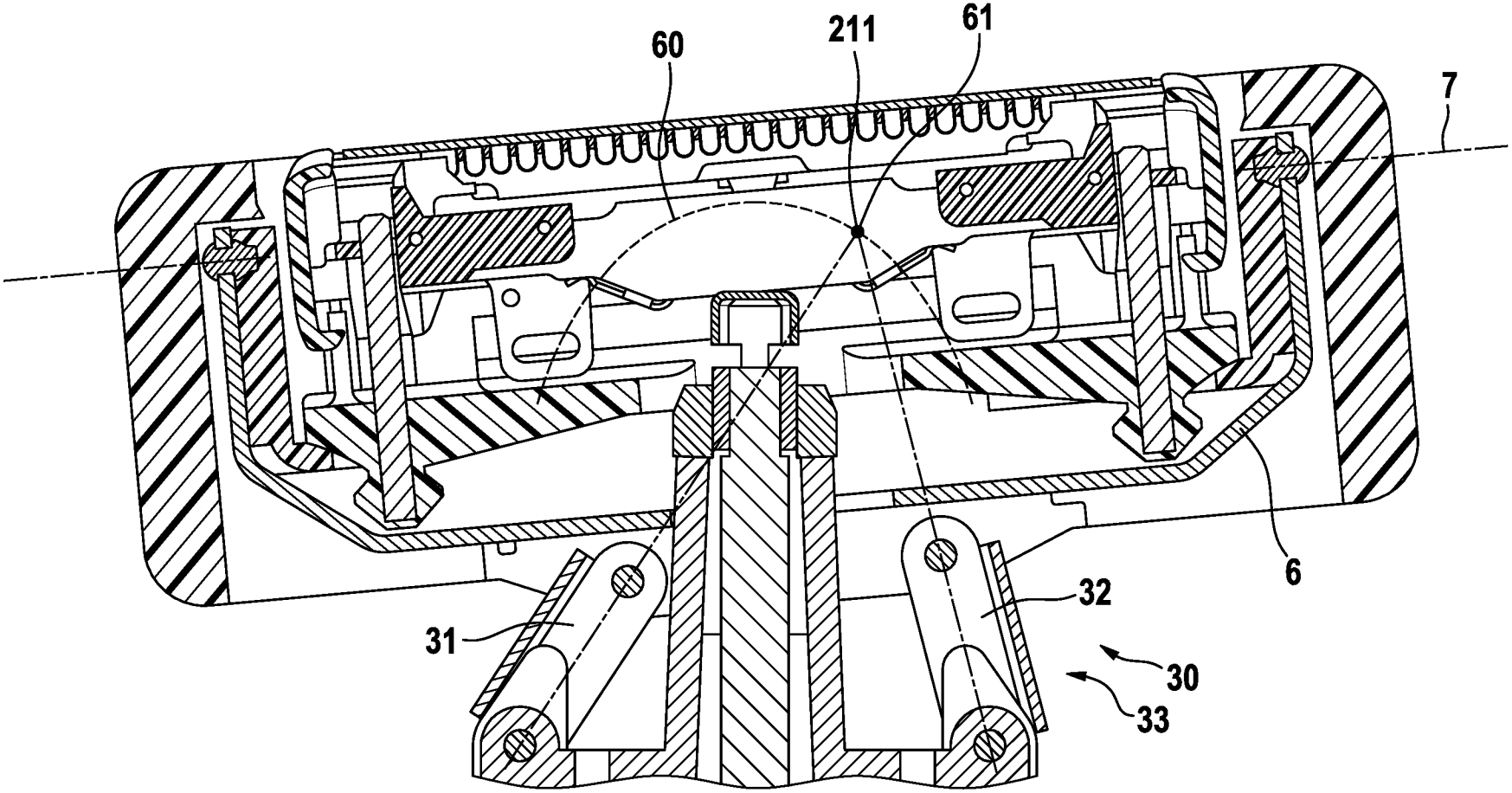
FIG. 8*b*: shows the shaver head in a tilted position with the link arms being pivoted and the shaver head, with a left side, lowered towards the handle, wherein both partial views show the shaver head's instantaneous center of rotation and the polhode thereof along which said instantaneous center of rotation moves, and the trajectory of left and right side ends of the cutter elements along which trajectories said left and right side ends move when tilting the shaver head.
Figure 9:
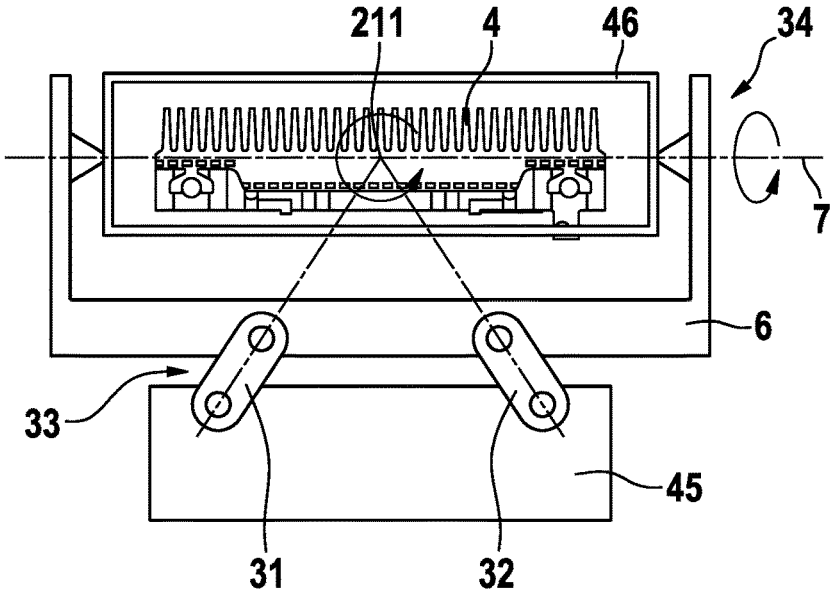
FIG. 9: a more schematic view of the support structure for the shaver head to illustrate the kinematics thereof.

As can be seen from FIGS. 8*a*-8*b* and 9, the handle joints 31*b* and 32*b* where the link arms 31 and 32 are pivotably connected to the handle 2 or base part 45 are spaced from each other at a distance L1 that is larger than the distance between the head joints 31*a* and 32*a* where the link arms 31 and 32 are pivotably connected to the shaver head part. The ratio between distance L1 to distance L2 may vary and/or may be adapted to the length of the link arms 31 and 32 so as to achieve the desired kinematics as explained before.

As can be seen from FIGS. 8*a*-8*b*, a shaver head frame 6 may be connected to the link arms 31 and 32 at the head joints 31*a* and 32*a* thereof which define pivot axes parallel to tilting axes 211. Consequently, the shaver head frame 6 may tilt relative to the handle 2 about said tilting axis 211.

Furthermore, said shaver head frame 6 may pivotably support another shaver head part such as a cutter support frame 46 to allow such cutter support frame 46 to swivel about a swivel axis 7 defined by such pivot bearing between the shaver head frame 6 and the cutter support frame 46. Such pivot bearing may include a shaft or stubble received within a hole or recess, wherein the swivel axis 7 may be fixed relative to the shaver head frame 6.

The aforementioned cutter element 4 may be supported at the cutter support frame 46, wherein the cutter elements 4 may be allowed to execute the aforementioned reciprocating drive movements along reciprocating axis 8 relative to the cutter support frame 46. In addition, the cutter elements 4 may dive relative to such cutter support frame 46 towards the handle 2.

Due to the aforementioned upright configuration of the four-joint linkage 33, the shaver head 3, after tilting thereof, may be brought back into its neutral or non-tilting position by means of a biasing means 70 that urges the shaver head 3 away from the handle 2 and/or away from the base part 45. As can be seen from FIG. 7, such biasing means 70 may include a spring device 28 urging the cutter unit away from the handle 2, wherein such spring may be positioned between the aforementioned cutter unit 100 and a drive train element for driving the cutter element 4 in a reciprocating manner. Thus, said biasing means 70 may fulfill a double function or multiple function including biasing the link arms 31 and 32 and thus, the shaver head 3 into their/its neutral, non-tilting position and allowing the cutter unit 4 to dive and/or float.

In addition or in the alternative to such diving of the cutter elements 4 relative to the shaver head structure, it also would be possible to allow for diving of the entire shaver head 3 including the cutter elements 4. For example, the aforementioned link arms 31 and 32 do not need to be connected directly to the handle 2, but they may be linked to a base part 45 which may be movably supported on the handle 2 to be moved basically along the longitudinal axis 20 of the handle 2. In other words, the base part 45 pivotably supporting the link arms 31 and 32 and thus the entire shaver head 3 may dive towards the handle 2, wherein a biasing device or spring device may be provided between the handle 2 and said base part 45 to bias or urge the base part 45 away from handle 2 and/or towards the shaver head 3 so that the shaver head 3 may dive against the biasing or spring force. In the alternative, however, such base part 45 also may be rigidly mounted on the handle 2.

Figure 10:
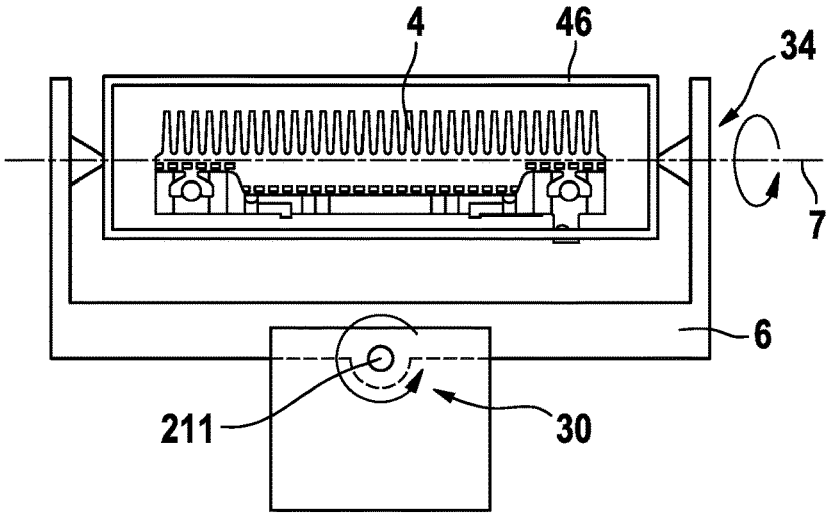
FIG. 10: a schematic view of the support structure for the shaver head according to an alternative aspect where a four-joint linkage for allowing tilting of the shaver head is supported on a swivel part allowing for swiveling of the shaver head.

As can be seen from FIGS. 8*a*-8*b* and 9, the swivel support structure is allowed to execute the tilting movements about tilting axis 211 as the four-joint linkage 33 allowing the tilting movements is arranged between the handle 2 and the swiveling support structure 34. However, as shown by FIG. 10, such order or structure may be reversed so that the four-joint linkage 33 allowing the tilting movements may execute swiveling movements. More particularly, a base part 45 may be pivotably supported on the handle 2 to be allowed to swivel about swivel axis 7 relative to handle 2, wherein the link arms 31 and 32 of the four-joint linkage 33, with their handle joints 31*b* and 32*b* may be connected to such swiveling base part 45, cf. FIG. 10.

Figure 11:
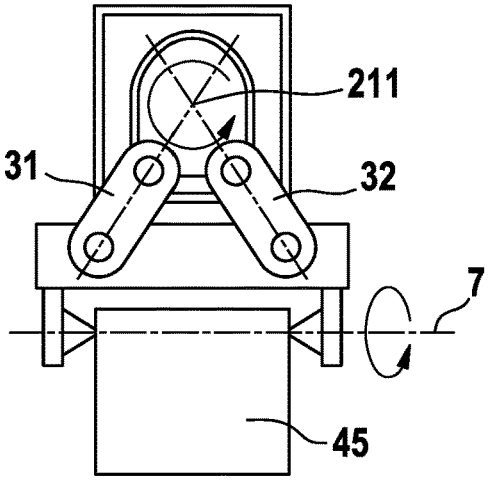
FIG. 11: a schematic view of a support structure for the shaver head according to an alternative aspect, wherein the swiveling axis and the tilting axis are both formed by pivot bearings.

Furthermore, as can be seen from FIG. 11, it also would be possible to have the four-point linkage 33 replaced by a pivot bearing structure. Thus, both swiveling and tilting may be achieved by means of respective pivot bearing structures.

As shown by FIGS. 8*a*-8*b* and 9, the swivel axis 7 may extend through or very close to the cutter elements 4, wherein said swivel axis 7 may extend between the cutter elements 4 when a pair of cutter elements is provided. For example, the swivel axis 7 may extend in the upper half of the shaver head 3, i.e. the half of the shaver head 3 further away from the handle 2, or may extend in the uppermost quarter of the shaver head 3 or through a top portion of the shaver head 3 where the block-like cutter elements 4 are accommodated.

The tilting axis 211 defined by the four-joint linkage 33 may be positioned closely to the swivel axis 7. More particularly, the tilting axis 211 may move due to the four-joint linkage 33 and the movements of the link arms 31 and 32. As can be seen from FIGS. 8*a*-8*b*, the crossing point of two virtual straight lines one of which goes through the head and handle joints 31*a* and 31*b* of one of the link arms 31 and another one of which goes through the head and handle joints 32*a* and 32*b* of the other one of the link arms 32, defines an instantaneous center of rotation 61 corresponding to tilting axis 211 which instantaneous center of rotation 61 may move along a path or polhode 60.

The link arms 31 and 32, in particular the length thereof and the positioning of the head joints and handle joints thereof, can be configured such that said polhode 60 along which the tilting axis 211 in terms of the instantaneous center of rotation 61 may move, has a contour convex towards the functional surface 56, when considering the limited working range of tilting of the shaver head relative to the handle during operation of the shaver, wherein such convex curve of the polhode 60 may have a rather shallow contour keeping the instantaneous center of rotation 61 close to the swivel axis 7 even when the shaver head 3 is tilted about tilting axis 211.

As can be seen from FIGS. 8*a*-8*b*, the link arms 31 and 32 may be configured such that the polhode 60 for tilting axis 211 may entirely extend within shaver head 3, wherein a major portion of such polhode 60 may extend in the upper half of the shaver head 3, i.e. the half of shaver head 3 further away from handle 2. For example, when considering the center point of the polhode 60 for the neutral or untilted shaver head position as shown by FIG. 8*a*, at least one third of the polhode 60 to the left and one third of the polhode 60 to the right may extend in the upper half of shaver head 3.

According to an aspect, the configuration of the link arms 31 and 32 may be chosen to have a virtual center point 41 of the shaver head 3 in the region of the cutter elements 4 move along a trajectory 62 when tilting the shaver head 3 about tilting axis 211, wherein said trajectory 61 may have a pitch roof-like configuration including two trajectory branches diverging from each other towards the handle 2. The aforementioned center point 41 may be considered to be a fixed point of the shaver head part attached to the head joints 31*a* and 32*a* of the link arm 31 and 32 in a region around the crossing point of the longitudinal handle axis 20 with the swivel axis 7 in a non-tilted position of the shaver head 3. When washing this center point 41 during tilting of the shaver head 3, the center point 41 moves along said trajectory 62 the contour of which is defined by the configuration of the four-point linkage 33. As shown by FIG. 8*a*, said trajectory 62 may have a convex contour when viewing said trajectory 62 from the functional surface side of shaver head 3, wherein the trajectory 62 may have a central peak from which two trajectory branches go down towards the handle 2. Due to such convex trajectory, also the center point 41 slightly dives when the shaver head 3 tilts.

The kinematics of the shaver head 3 with regard to tilting thereof may provide for good control of contour adaption and improved handling of the shaver. In particular, the shaver head 3 shows an increased stability against tilting when the shaver head 3 is in its neutral or non-tilted position or only slightly tilted, whereas the shaver head is more easily further tilted when it has already been tilted to a certain degree. In other words, the shaver head's willingness to tilt increases with an increasing tilting angle.

Figure 12A:
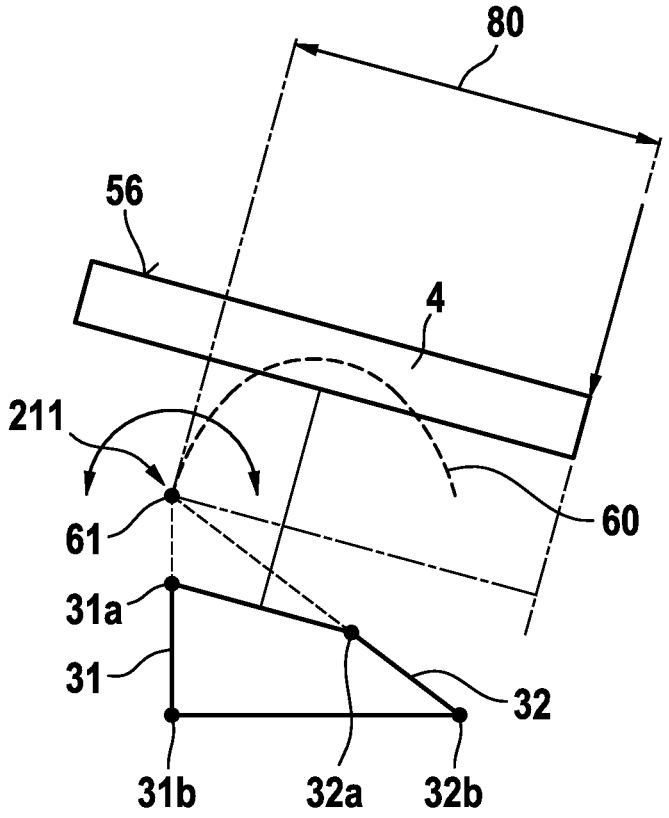
FIG. 12*a*: a schematic view of the position of the instantaneous center of rotation of the shaver head for an already tilted position of the shaver head to illustrate the lever arm of a tilting force and contact pressure, thus showing the willingness of the shaver head to tilt further.
Figure 12B:
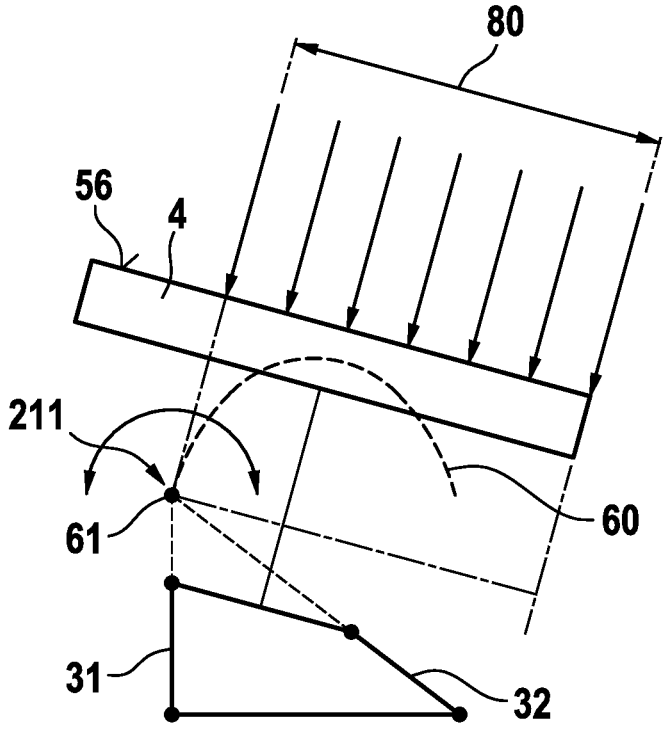
FIG. 12*b*: another view of the shaver head of FIG. 12*a*, with the shaver head tilted showing a contact pressure.

This can be seen from FIGS. 12*a*-12*b* and may be achieved or at least supported by the instantaneous center of rotation defining tilting axis 211 moving away from the end side of shaver head 3 at which end side the shaver head 3 dives towards the handle when tilting. For example, FIGS. 12*a*-12*b* shows a right hand side of shaver head 3 diving due to clockwise tilting. Due to the configuration of the four-joint linkage 33 causing the tilting axis 211, more particularly the instantaneous center of rotation to move towards the left end side of the shaver head 3 along the polhode 60, the lever arm of a contact force urging the shaver head 3 to further tilt, gets a lever arm 80 that increases with an increasing tilting angle. The further shaver head 3 tilts towards the right side, the further the instantaneous center of rotation moves towards the left side what increases the portion of the functional surface 56 on which contact pressure gets a lever arm to further tilt the shaver head 3, cf. partial view (b) of FIG. 12.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An electric shaver comprising:

a. a handle, and b. a shaver head including at least one cutter unit including a cutter element and a shear foil, c. wherein said shaver head is connected to said handle by a support structure comprising at least one link arm, said support structure providing for a swivel axis and a tilting axis about which said shaver head can swivel or tilt relative to said handle, d. wherein said cutter element is drivable by a drive unit in an oscillating manner along a cutter oscillation axis, said drive unit including an elongated drive transmitter coupled to said cutter element, e. wherein said elongated drive transmitter is coupled to said cutter element by a pivot joint providing for a pair of pivot axes extending perpendicular to each other and transverse to a longitudinal axis of said elongated drive transmitter to allow said cutter element multiaxial pivoting relative to said elongated drive transmitter, and f. wherein said pivot joint is mounted to said elongated drive transmitter and to said cutter element fixedly in the direction of said cutter oscillation axis and displaceably in directions perpendicular thereto to allow for displacement of said pivot joint relative to said cutter element in a first direction transverse to the cutter oscillation axis and to the longitudinal axis of said elongated drive transmitter and relative to said elongated drive transmitter and to said cutter element in a second direction parallel to the longitudinal axis of said elongated drive transmitter, wherein said elongated drive transmitter includes a shaft rotatable in an oscillating manner and extending from said handle into said shaver head, wherein a rigid drive pin is rigidly attached to a crank arm rigidly fixed to said shaft to execute an oscillating driving movement, said drive pin being connected to the cutter element by means of said pivot joint.

2. The electric shaver according to claim 1, wherein said elongated drive transmitter is rotatably but otherwise fixedly supported so that the longitudinal axis defined by the drive pin extends in a fixed orientation relative to said handle.

3. An electric shaver comprising:

a. a handle, and b. a shaver head including at least one cutter unit including a cutter element and a shear foil, c. wherein said shaver head is connected to said handle by a support structure comprising at least one link arm, said support structure providing for a swivel axis and a tilting axis about which said shaver head can swivel or tilt relative to said handle, d. wherein said cutter element is drivable by a drive unit in an oscillating manner along a cutter oscillation axis, said drive unit including an elongated drive transmitter coupled to said cutter element, e. wherein said elongated drive transmitter is coupled to said cutter element by a pivot joint providing for a pair of pivot axes extending perpendicular to each other and transverse to a longitudinal axis of said elongated drive transmitter to allow said cutter element multiaxial pivoting relative to said elongated drive transmitter, and f. wherein said pivot joint is mounted to said elongated drive transmitter and to said cutter element fixedly in the direction of said cutter oscillation axis and displaceably in directions perpendicular thereto to allow for displacement of said pivot joint relative to said cutter element in a first direction transverse to the cutter oscillation axis and to the longitudinal axis of said elongated drive transmitter and relative to said elongated drive transmitter and to said cutter element in a second direction parallel to the longitudinal axis of said elongated drive transmitter, wherein said elongated drive transmitter extends into an interior transmitter recess formed in said cutter element in which an end portion of said elongated drive transmitter is received pivotably about said pair of pivot axes and displaceable in said first direction transverse to said cutter oscillation axis and transverse to said longitudinal axis of said elongated drive transmitter.

4. The electric shaver according to claim 3, wherein said elongated drive transmitter is in direct engagement and direct contact with body walls of said cutter element defining said interior transmitter recess forming said pivot joint, which direct engagement and direct contact is free of play in the direction of said cutter oscillation axis.

5. The electric shaver according to claim 3, wherein said interior transmitter recess of the cutter element forms an elongated, slot-like hole having concave side walls defining a gap the width of which corresponds to a thickness of an end portion of said elongated drive transmitter and the length of which is larger than said thickness of said elongated drive transmitter, said width extending parallel to said cutter oscillation axis and said length extending transverse to said cutter oscillation axis and transverse to the longitudinal axis of said elongated drive transmitter.

6. An electric shaver comprising:

a. a handle, and b. a shaver head including at least one cutter unit including a cutter element and a shear foil, c. wherein said shaver head is connected to said handle by a support structure comprising at least one link arm, said support structure providing for a swivel axis and a tilting axis about which said shaver head can swivel or tilt relative to said handle, d. wherein said cutter element is drivable by a drive unit in an oscillating manner along a cutter oscillation axis, said drive unit including an elongated drive transmitter coupled to said cutter element, e. wherein said elongated drive transmitter is coupled to said cutter element by a pivot joint providing for a pair of pivot axes extending perpendicular to each other and transverse to a longitudinal axis of said elongated drive transmitter to allow said cutter element multiaxial pivoting relative to said elongated drive transmitter, and f. wherein said pivot joint is mounted to said elongated drive transmitter and to said cutter element fixedly in the direction of said cutter oscillation axis and displaceably in directions perpendicular thereto to allow for displacement of said pivot joint relative to said cutter element in a first direction transverse to the cutter oscillation axis and to the longitudinal axis of said elongated drive transmitter and relative to said elongated drive transmitter and to said cutter element in a second direction parallel to the longitudinal axis of said elongated drive transmitter.

7. The electric shaver according to claim 1, wherein said pivot joint is rotatably mounted to said elongated drive transmitter and/or to said cutter element to allow for rotation of said pivot joint relative to the elongated drive transmitter and to said cutter element about an axis of rotation parallel to the longitudinal axis of said elongated drive transmitter.

8. The electric shaver according to claim 1, wherein said pivot joint includes a ball-and/or block-and/or sleeve-like connector connecting an end portion of said elongated drive transmitter to said cutter element, wherein said connector is slidably mounted onto said end portion of the drive transmitter to slide along the longitudinal axis of said drive transmitter, thereby allowing the cutter element to dive relative to the drive transmitter in the direction of the longitudinal axis thereof, wherein said connector of the pivot joint forms a ball joint piece having a spherical support surface in pivotable engagement with a support surface of the cutter element.

9. The electric shaver according to claim 1, wherein pivot joint support surfaces of the cutter element for supporting the pivot joint are formed integrally with or rigidly fixed to a cutter element body of said cutter element, or provided on a cutter element spring connected to a cutter element body of said cutter element and elastically biasing said cutter element body against a shear foil of said shaver head.

10. The electric shaver according to claim 1, wherein, in at least some positions of the cutter element and of said shaver head, said pair of pivot axes of said pivot joint are spaced apart from the swivel axis of the shaver head, and from the tilting axis of said shaver head in at least some swiveling and tilting positions of the shaver head.

11. The electric shaver according to claim 1, wherein said at least one link arm comprises a pair of link arms forming a four-joint linkage with each link arm having a head joint connected to a shaver head part and a handle joint connected to the handle or a base part connected thereto.

12. The electric shaver according to claim 11, wherein said link arms are mounted in a standing configuration with the head joints of the link arms further away from the handle than the handle joints of the link arms.

13. The electric shaver according to claim 12, wherein said link arms provide for the tilting axis extending transverse to a longitudinal axis of the handle and transverse to the cutter oscillation axis of the cutter element.

14. The electric shaver according to claim 13, wherein said link arms, in a neutral or intermediate or non-tilting position of the shaver head, are arranged in a double pitch roof-like configuration with a distance of the handle joints of the link arms from each other being larger than a distance of the head joints of the link arms from each other.

15. The electric shaver according to claim 14, wherein said link arms are configured to define an instantaneous center of rotation moving along a path extending through and adjacent to said cutter element and having a curved shape which is convex towards a functional side of the shaver head to be contacted with the skin to be shaved when considering a working range of rotation of the shaver head relative to the handle, and are configured to define the instantaneous center of rotation moving further away from a diving side of the shaver head on which diving side the shaver head dives towards the handle when rotating about the tilting axis defined by the link arms.

16. The electric shaver according to claim 11, wherein at least one of the following (d)-(f) is given: (d) biasing means are provided for biasing the shaver head away from the handle and away from the base part, thereby biasing the shaver head into a neutral or non-tilting position of the link arms and allowing the cutter unit to float, (e) said elongated drive transmitter extends in-between said pair of link arms arranged on opposite sides of said drive transmitter, (f) wherein said pair of link arms, with their handle joints, are connected to the base part which is movably supported onto the handle to allow diving of the entire support structure towards the handle along the longitudinal axis of the handle, wherein a biasing device or spring device is provided for biasing or urging the base part away from the handle.

17. The electric shaver according to claim 1, wherein the support structure provides for the swivel axis extending through and adjacent to a functional surface of the cutter element, said swivel axis extending transverse to a longitudinal axis of the handle and substantially parallel to a reciprocating axis of the cutter element, wherein at least one of the following (a)-(c) is given: (a) said swivel axis allows for swiveling of the cutter element relative to a shaver head frame which is tiltable about the tilting axis relative to the handle, (b) said swivel axis is formed by a pivot bearing providing for a fixed pivot axis, (c) said swivel axis and said tilting axis extend in or immediately adjacent to a virtual plane containing said pivot joint connecting the cutter element to the drive transmitter and extending substantially perpendicular to the longitudinal axis of the handle.

* * * * *